US010765231B2

(12) United States Patent
Eget et al.

(10) Patent No.: US 10,765,231 B2
(45) Date of Patent: Sep. 8, 2020

(54) DISCHARGE AIR STRAIGHTENER

(71) Applicant: Hill Phoenix, Inc., Conyers, GA (US)

(72) Inventors: Lawrence William Eget, Powhatan, VA (US); T. Dean Swofford, Midlothian, VA (US); Roy Bates, Chesterfield, VA (US)

(73) Assignee: Hill Phoenix, Inc., Conyers, GA (US)

( * ) Notice: Subject to any disclaimer, the term of this patent is extended or adjusted under 35 U.S.C. 154(b) by 782 days.

(21) Appl. No.: 15/041,860

(22) Filed: Feb. 11, 2016

(65) Prior Publication Data

US 2017/0231403 A1 Aug. 17, 2017

(51) Int. Cl.

| | |
|---|---|
| ***A47F 3/04*** | (2006.01) |
| ***A47F 3/00*** | (2006.01) |
| ***F25D 23/02*** | (2006.01) |

(52) U.S. Cl.

CPC ..... *A47F 3/0447* (2013.01); *A47F 3/001* (2013.01); *A47F 3/0469* (2013.01); *F25D 23/023* (2013.01); *F25D 2317/063* (2013.01)

(58) Field of Classification Search

CPC ..... A47F 3/001; A47F 3/0447; F25D 23/023
USPC ..... 454/192
See application file for complete search history.

(56) References Cited

U.S. PATENT DOCUMENTS 1,982,465 A * 11/1934 Herbert ..... F24F 6/04 261/104
2,616,355 A * 11/1952 McCabe ..... F24F 13/062 454/312
3,463,433 A * 8/1969 Coe ..... A47B 57/045 248/242

(Continued)

FOREIGN PATENT DOCUMENTS

AU 2014252898 A1 11/2015
CA 2908918 A1 10/2014

(Continued)

OTHER PUBLICATIONS

Asada et al, JP 2011-188889 A English machine translation, Sep. 29, 2011.*

(Continued)

*Primary Examiner* — Edelmira Bosques
*Assistant Examiner* — Phillip Decker
(74) *Attorney, Agent, or Firm* — Foley & Lardner LLP

(57) ABSTRACT

A temperature controlled case includes a number of shelves, an air-curtain, and a number of air-straighteners. The number of shelves individually support a displayed product. The number of shelves are mounted to the temperature controlled case. The air-curtain originates at an air-curtain discharge and terminates an air-curtain return. The number of air-straighteners is equal to the number of shelves. The number of air straighteners individually include a flow guide and are individually coupled to one of the number of shelves. The flow guides are located at locations within the air-curtain. The flow guides are configured to control the air-curtain. The flow guides individually include a luminaire comprising a number of LEDs coupled to a number of PCBs. The luminaires are configured to illuminate a number of illumination targets. The number of illumination targets correspond to at least one of the displayed products.

18 Claims, 11 Drawing Sheets

(56) References Cited

U.S. PATENT DOCUMENTS

| | | | | | |
|---|---|---|---|---|---|
| 3,561,713 | A * | 2/1971 | Berkowitz | A47B 57/045 | 248/242 |
| 3,601,033 | A * | 8/1971 | Lambert | E04B 9/02 | 454/292 |
| 4,202,254 | A * | 5/1980 | Long | B60J 1/20 | 296/96.11 |
| 4,399,970 | A * | 8/1983 | Evans | B64C 9/24 | 244/214 |
| 4,466,254 | A * | 8/1984 | Karashima | A47F 3/0447 | 454/193 |
| 4,552,272 | A * | 11/1985 | Field | A47F 5/0846 | 108/61 |
| 4,620,489 | A * | 11/1986 | Albano | A47B 96/025 | 108/105 |
| 4,934,645 | A * | 6/1990 | Breslow | A47B 96/07 | 108/108 |
| 5,048,303 | A * | 9/1991 | Campbell | A47F 3/0447 | 62/256 |
| 5,220,739 | A * | 6/1993 | Chich | G09F 13/04 | 40/550 |
| 5,452,875 | A * | 9/1995 | Kern | A47B 57/045 | 108/108 |
| 5,531,159 | A * | 7/1996 | Stubblefield | A47B 46/00 | 108/100 |
| 5,586,935 | A * | 12/1996 | Kotoh | F16K 1/165 | 454/285 |
| 5,738,019 | A * | 4/1998 | Parker | A47B 46/00 | 108/108 |
| 6,234,328 | B1 * | 5/2001 | Mason | A47B 57/045 | 211/150 |
| 7,036,947 | B2 * | 5/2006 | Chuang | A47F 3/001 | 362/126 |
| 7,121,104 | B2 * | 10/2006 | Howington | A47B 57/045 | 62/256 |
| 7,513,637 | B2 * | 4/2009 | Kelly | A47F 3/001 | 362/126 |
| 9,480,346 | B2 * | 11/2016 | Houle | A47F 5/0068 | |
| 9,679,503 | B2 * | 6/2017 | Weyer | A47F 5/0869 | |
| 2005/0030736 | A1 * | 2/2005 | Chuang | A47F 3/001 | 362/92 |
| 2005/0217297 | A1 | 10/2005 | Wilson | | |
| 2007/0251253 | A1 | 11/2007 | Alahyari et al. | | |
| 2008/0205044 | A1 * | 8/2008 | Shibusawa | A47F 3/001 | 362/126 |
| 2008/0212314 | A1 * | 9/2008 | Swofford | A47F 3/001 | 362/126 |
| 2008/0236182 | A1 | 10/2008 | Hahn et al. | | |
| 2010/0001660 | A1 * | 1/2010 | Pas | A47F 3/001 | 315/292 |
| 2010/0195317 | A1 * | 8/2010 | Oketani | A47F 3/001 | 362/125 |
| 2011/0044030 | A1 * | 2/2011 | Pichel | A47F 11/10 | 362/125 |
| 2015/0116990 | A1 * | 4/2015 | Cassidy | F21V 5/04 | 362/126 |
| 2015/0374141 | A1 | 12/2015 | Wirth | | |
| 2015/0374142 | A1 | 12/2015 | Wirth | | |
| 2016/0100698 | A1 * | 4/2016 | Clark | A47F 3/001 | 362/612 |
| 2016/0153705 | A1 * | 6/2016 | Dubuc | A47F 3/0404 | 312/405.1 |
| 2016/0174734 | A1 * | 6/2016 | Artwohl | A47F 3/005 | 428/34 |
| 2016/0278542 | A1 * | 9/2016 | Eget | A47F 3/0408 | |
| 2019/0142186 | A1 * | 5/2019 | Wirth | A47F 3/0447 | |

FOREIGN PATENT DOCUMENTS

| | | | | | |
|---|---|---|---|---|---|
| CN | 105164480 | A | | 12/2015 | |
| EP | 1 508 288 | A1 | | 2/2005 | |
| EP | 2 984 424 | | | 2/2017 | |
| FR | 2690825 | A1 | | 11/1993 | |
| GB | 992490 | A | * | 5/1965 | A47F 3/0447 |
| GB | 1352298 | A | * | 5/1974 | A47F 3/001 |
| GB | 2 519 463 | A | | 4/2015 | |
| GB | 2 522 571 | A | | 7/2015 | |
| JP | S51-150569 | U | | 12/1976 | |
| JP | S55-165468 | A | | 12/1980 | |
| JP | S57-58884 | U | | 4/1982 | |
| JP | S58-110977 | | | 7/1983 | |
| JP | S59-174588 | U | | 11/1984 | |
| JP | 2001-169874 | A | * | 6/2001 | |
| JP | 2010-207564 | A | | 9/2010 | |
| JP | 2011-104081 | | | 6/2011 | |
| JP | 2011-131036 | A | | 7/2011 | |
| JP | 2011-167384 | A | | 9/2011 | |
| JP | 2011-188889 | A | | 9/2011 | |
| JP | 2012-161409 | | | 8/2012 | |
| JP | 2014-108180 | | | 6/2014 | |
| JP | 5531574 | B2 | | 6/2014 | |
| WO | WO-2014/167320 | | | 10/2014 | |
| WO | WO-2018020260 | A1 | * | 2/2018 | A47F 3/0447 |

OTHER PUBLICATIONS

JPS59-174588 U English machine translation, Nov. 21, 1984.*

Urakawa et al, JP 2011-131036 A English machine translation, Jul. 7, 2011.*

Matsuzaki et al, JP 2011-167384 A English machine translation, Sep. 1, 2011.*

Aerofoil Energy Ltd, The Alternative Solution to Multideck Glass Doors, available at least as early as Apr. 28, 2015, Retrieved from the Internet at http://www.aerofoil-energy.co.uk/ on Feb. 16, 2016, 5 pages as printed.

Brian, M., "F1 tech is about to make its way to supermarket fridges," Engadget, Dec. 28, 2015, Retrieved from the Internet at http://www.engadget.com/2015/12/28/williams-f1-aerofoil-energy-fridges/ on Feb. 16, 2016, 5 pages as printed.

McAndrew P., "Fridgeland UK Ltd launces AERO Multidecks—featuring cutting edge Aerofoil technology," LinkedIn, Jun. 23, 2015, Retrieved from the Internet at https://www.linkedin.com/pulse/fridgeland-uk-ltd-launches-aero-multidecks-cutting-edge-p-mcandrew on Feb. 16, 2016, 2 pages as printed.

Rac, "Give the edge to shelving," Refrigeration and Air Conditioning, Jun. 2014, Retrieved from the Internet at http://www.aerofoil-energy.co.uk/images/024_racjune2014_aerofoils.pdf on Feb. 16, 2016, 1 page.

Williams Advanced Engineering, "Supermarket Fridges Become More Energy Efficient Thanks to F1 Aerodynamics," Williams F1, Apr. 24, 2015, Retrieved from the Internet at http://www.williamsf1.com/advanced-engineering/news/supermarketfridgesbecomemoreenergyefficient on Feb. 16, 2016, 2 pages as printed.

* cited by examiner

DISCHARGE AIR STRAIGHTENER

TECHNICAL FIELD

The present disclosure relates to a temperature controlled case. More specifically, the present disclosure relates to a system for controlling an air-curtain of a temperature controlled case.

BACKGROUND

Temperature controlled cases are used for the storage, preservation, and presentation of products, such as food products including perishable meat, dairy, seafood, produce, etc. Temperature controlled cases may contain a number of shelves, each of which may be used to display products. Temperature controlled cases (e.g., refrigerated cases, freezers, merchandisers, etc.) may be used in both commercial and residential settings. For example and in regard to a commercial setting, grocer's stores or supermarkets typically have one or more aisles lined with temperature controlled cases or have one or more temperature controlled cases positioned in a desirable location.

To facilitate the preservation of the products, temperature controlled cases often include one or more cooling systems for maintaining a display area of the case at a desired temperature. The cooling systems may circulate refrigerated air to both remove heat from displayed products and to establish a protective air-curtain barrier between a temperature controlled zone and ambient conditions outside of the temperature controlled case. The air-curtain may be disposed behind a door of the temperature controlled case. Typical temperature controlled cases may have difficulty controlling the air-curtain along the length of the door, resulting in the introduction of ambient air into the air-curtain and/or the loss of refrigerated air from the air-curtain. As a result, typical temperature controlled cases may experience moisture buildup that negatively impacts the performance, efficiency, or desirability of the temperature controlled case. Accordingly, it is desirable to increase the effectiveness of the air-curtain in providing a barrier between the temperature controlled zone of the temperature controlled case and the ambient conditions outside of the temperature controlled case to prevent moisture buildup inside the temperature controlled case.

To facilitate the viewing of products, typical temperature controlled cases may include lighting elements (e.g., T8 fluorescents, light emitting diodes, etc.). Due to the depth and angle of the shelves in the temperature controlled case, these lighting elements may be placed beneath the shelves of the temperature controlled case, such that products on each shelf may be adequately illuminated. However, the lighting elements may undesirably produce heat within the temperature controlled case, near the products, which must be removed by the cooling system. As a result, the cooling system of the temperature controlled case may have to consume additional power due to the lighting elements. In some instances, the temperature controlled case may not be able to adequately compensate for the heat provided by the lighting elements. Accordingly, some products may be damaged due to over-cooling or undercooling of the products. Further, these lighting elements may be placed in close proximity to the shelves of the typical temperature controlled case, thereby reducing an illuminated region associated with the lighting elements. Accordingly, it is desirable to provide lighting elements that are not placed in confronting relation with products and which illuminate products on various shelves for a number of possible angles and orientations of the shelves of a temperature controlled case.

SUMMARY

One embodiment relates to a temperature controlled case. The temperature controlled case includes a number of shelves, an air-curtain, and a number of air-straighteners. The number of shelves individually support a displayed product. The number of shelves are mounted to the temperature controlled case. The air-curtain originates at an air-curtain discharge and terminates an air-curtain return. The number of air-straighteners is equal to the number of shelves. The number of air straighteners individually include a flow guide and are individually coupled to one of the number of shelves. The flow guides are located at locations within the air-curtain. The flow guides are configured to control the air-curtain. The flow guides individually include a luminaire comprising a number of LEDs coupled to a number of PCBs. The luminaires are configured to illuminate a number of illumination targets. The number of illumination targets correspond to at least one of the displayed products.

Another embodiment relates to a temperature controlled case. The temperature controlled case includes an air-curtain, a first shelf, a second shelf, and an air straightener. The air-curtain originates at an air-curtain discharge and terminates at an air-curtain return. The first shelf is defined by a first length. The second shelf is below the first shelf and is defined by a second length that is different than the first length. The air straightener includes a flow guide. The air straightener is coupled to the first shelf. The air straightener is disposed within the air-curtain at a location between, and separate from, the air-curtain discharge and the air-curtain return. The flow guide includes a luminaire. The luminaire includes a number of LEDs coupled to a number of PCBs. The luminaire has an illumination target where light produced by the number of LEDs is directed. The illumination target is located on the second shelf.

One embodiment relates to an air straightener for a temperature controlled case. The air straightener includes a flow guide and a number of support arms. The flow guide is disposed within an air-curtain. The flow guide includes a lower channel, an upper channel, a bottom retaining edge, a top retaining edge, a luminaire, and a lens. The upper channel is separate from the lower channel. The luminaire includes a number of LEDs coupled to a number of PCBs. The lens includes a lower leg, an upper leg, a lower edge, and an upper edge.

DETAILED DESCRIPTION

Figure 1:
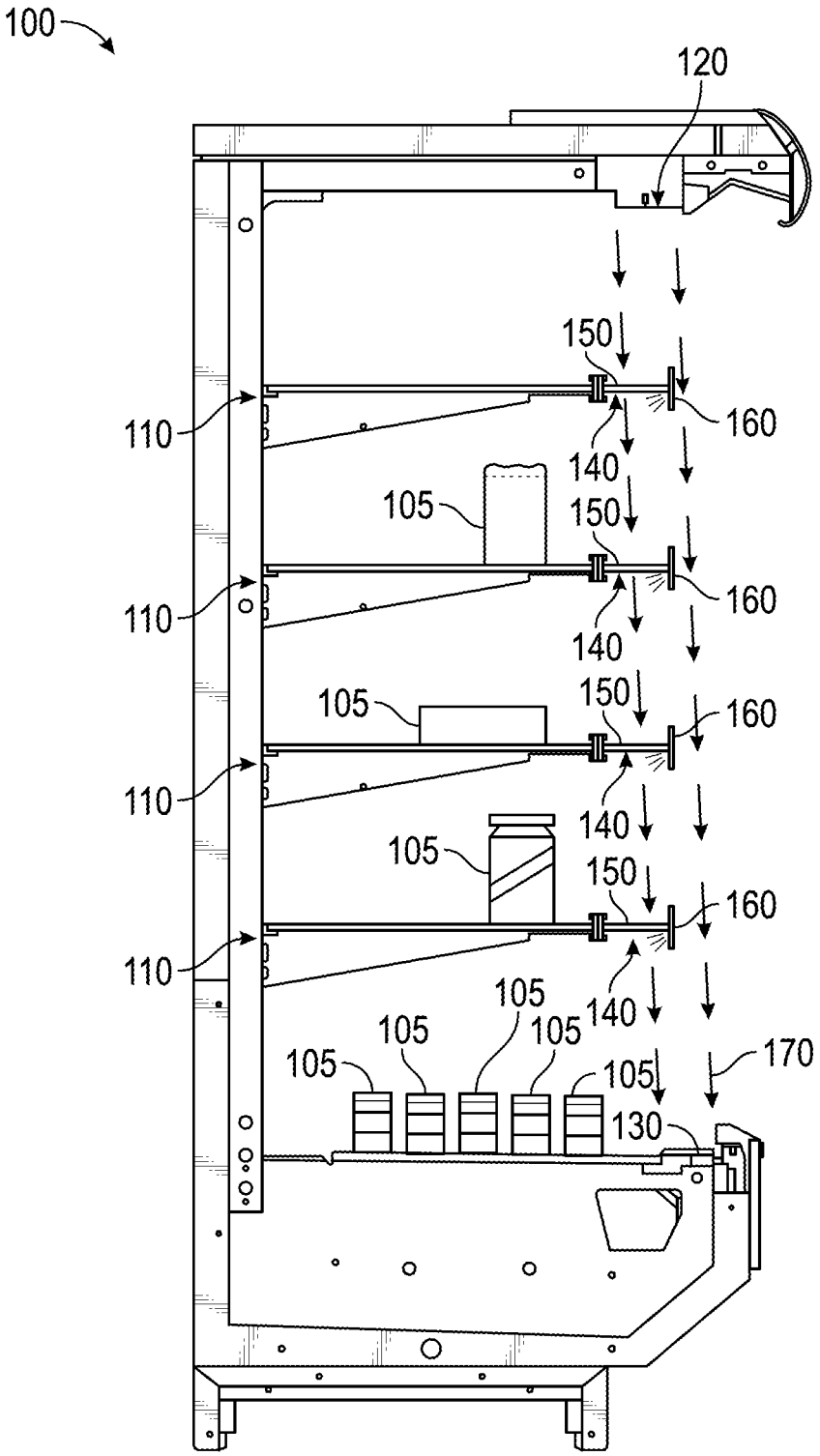
FIG. 1 is a side cross-sectional view of a temperature controlled case, according to an exemplary embodiment of the present disclosure.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to flow guides for a temperature controlled case. A number of the flow guides may be incorporated on air straighteners mounted within a temperature controlled case. The flow guides may interface with an air-curtain to control the direction of the air-curtain at various locations within the air-curtain. The flow guides may also be configured to illuminate products on various shelves. The flow guides may be mounted to various shelves within the temperature controlled case and/or mounted directly to the temperature controlled case. In some embodiments, the flow guides are incorporated into the shelves. The flow guides may produce an effect configured to control the air-curtain along a travel defined from an air-curtain discharge to an air-curtain return. According to one embodiment, the flow guides are angularly displaced relative to a primary direction of the air-curtain.

The flow guides may contain luminaires. The luminaires may contain printed circuit boards (PCBs) having surface-mount devices (SMDs) and light emitting diode (LEDs). The luminaires may have a number of illumination targets where light from the LEDs is focused. The illumination targets may correspond to displayed products on the various shelves in the temperature controlled case. The luminaires may be configured to illuminate shelves below the luminaires. The air straighteners may include a gravity orientation mechanism configured to facilitate a desired orientation of the flow guides. The air straighteners or shelves may include a cam-track mechanism configured to allow the air straighteners or the shelves, respectively, to be reconfigured. The gravity orientation mechanism and the cam-track mechanism may be utilized to maintain illumination of products on various shelves after the shelves have been reconfigured.

Advantageously, the flow guides may control the air-curtain such that air from the air-curtain is substantially maintained within the air-curtain, air from outside of the temperature controlled case is substantially prohibited from entering the air-curtain, and air from within the temperature controlled case is substantially prohibited from leaving the temperature controlled case. Rather than mixing air from the air-curtain and outside of the temperature controlled case, thereby resulting in moisture buildup that may require larger fans and result in greater inefficiency, the temperature controlled case of the present disclosure may provide an effective barrier between the air-curtain and the air outside of the temperature controlled case. Accordingly, the temperature controlled case of the present disclosure may operate in a relatively more efficient manner and consume less energy than a typical temperature controlled case.

The flow guides may illuminate products on shelves of varying lengths. For example, a first shelf having a flow guide and being defined by a length may illuminate a second shelf having a length less than the length of the first shelf. In various embodiments, the air-curtain cools the luminaires thereby reducing temperature increase of the temperature controlled case due to illumination compared to a typical temperature controlled display case. The air straighteners, flow guides, luminaires, and various components thereof are configured to be interchangeable and upgradable such that the temperature controlled case may be tailored for a target application. These and other features of the present disclosure are described more fully herein.

Referring now to FIG. 1, a first display case, shown as temperature controlled case 100 for displaying products (e.g., produce, dairy products, beverages, meat products, etc.), shown as products 105, includes a first number of shelves, shown as shelves 110, a first air discharge (e.g., origin, etc.), shown as air-curtain discharge 120, and a first air return, shown as air-curtain return 130. Products 105 may be representative of a number of different products which may be placed on shelves 110. Individually, shelves 110 may include a first number of air straighteners, shown as air straighteners 140. Display cases, such as temperature controlled case 100, may be utilized to display products, such as food products including perishable meat, dairy, seafood, and produce. Temperature controlled case 100 may be mounted on a mounting surface (e.g., floor, ground, etc.) and have an exterior proximate an ambient environment (e.g., outside environment, store environment, etc.) having ambient conditions (e.g., outside conditions, store conditions, etc.) and an interior having a temperature controlled zone. According to various embodiments, shelves 110 are configured to support products for display within temperature controlled case 100 and to be mounted to temperature controlled case 100. For example, fresh dairy products (e.g., milk, cheese, eggs, etc.) may be displayed on shelves 110. In some applications, it may be desirable for shelves 110 to be mounted such that shelves 110 are substantially parallel to the mounting surface. In other applications, it may be desirable for shelves 110 to be mounted such that shelves 110 are at an angle relative to the mounting surface. For example, shelves 110 may be mounted such that shelves 110 are at an angle towards the mounting surface (e.g., mounted at a downward angle). Shelves 110 may be spaced a target distance apart in both vertical and horizontal directions to allow for various products to be displayed. Temperature controlled case 100 may include more or less shelves 110 depending on the target distances between each of shelves 110 such that temperature controlled case 100 may be tailored for a target application. In other embodiments, air straighteners 140 are mounted to temperature controlled case 100.

A typical temperature controlled case may utilize lighting elements (e.g., T8 fluorescents) to provide lighting inside the typical temperature controlled case. These lighting elements are usually mounted directly to the underside of a shelf, underneath displayed product. The lighting elements may be mounted directly under the shelves in order to minimize visual impact of the lighting elements on a customer and to maximize the refrigerated volume of the temperature controlled case. However, the arrangement of the lighting elements in the typical temperature controlled case may result in heat generation problems, and thereby cooling problems for the temperature controlled case. Further, the lighting elements may result in localized heat generation problems because they are mounted such that they are in confronting relation with a shelf of the typical temperature controlled case. In other applications, the lighting elements are mounted near a top cornice of the typical temperature controlled case. In these applications, light from the lighting element may not adequately illuminate lower shelves.

Accordingly, in many applications it may be desirable to adequately illuminate all products in a temperature controlled case without introducing a substantial amount of heat into the temperature controlled case. Air straighteners 140 may include a luminaire configured to illuminate products 105 on shelves 110. The top shelf 110 in temperature controlled case 100 may be lit by the luminaire, ambient light, or an auxiliary light positioned proximate the top cornice of temperature controlled case 100. The luminaire may facilitate illumination of products 105 along the entire length of various shelves 110. Conversely, the lighting elements of the typical temperature controlled case may contain dead spots where illumination is not adequately present, such as a front portion of the shelves. For example, in a typical temperature controlled case including a first shelf having a first length and a second shelf having a second length greater than the first length, products displayed on a front portion of the second shelf may not be adequately illuminated by a lighting element mounted under the first shelf. As a result, typical temperature controlled cases may utilize shelves that are of similar length resulting in a temperature controlled case that is less desirable. Accordingly, in the typical temperature controlled case, the front faces of products containing important information (e.g., product name, price, etc.) may not be easily visible to a customer. This results in decreased capacity and/or undesirable operation of the typical temperature controlled case. Luminaires, such as that included in air straighteners 140, may facilitate uniform placement of products 105 on shelves 110. Further, the luminaires may facilitate increased storage capacity of shelves 110 compared to the shelves of a typical temperature controlled case.

According to various embodiments, shelves 110 of temperature controlled case 100 are of different lengths (e.g., fifty centimeters, fifty-six centimeters, sixty-one centimeters, etc.). The length of a shelf (e.g., shelf 110) may be defined as a distance from a back wall of the temperature controlled case (e.g., temperature controlled case 100) to a front edge of the shelf in confronting relation with an air-curtain (e.g., air-curtain 170). In one example, temperature controlled case 100 may have a first shelf 110 having a length of approximately fifty centimeters (e.g., twenty inches), a second shelf 110 having a length of approximately fifty-six centimeters (e.g., twenty-two inches), and a third shelf 110 having a length of approximately fifty centimeters. In other embodiments, shelves 110 of temperature controlled case 100 are all the same length. The luminaires may advantageously facilitate adequate lighting of products 105 on each of shelves 110 such that a front face of products 105 may readily be visible by a customer.

Temperature controlled case 100 may be a refrigerator, a freezer, a refrigerated merchandiser, a refrigerated display case, or other device capable of use in a commercial, institutional, or residential setting for storing and/or displaying refrigerated and/or frozen objects. For example, temperature controlled case 100 may be a service type refrigerated display case for displaying fresh food products (e.g., meat, dairy, produce, etc.) in a supermarket or other commercial setting. Temperature controlled case 100 may be configured to provide a refrigerated zone and/or a heated zone within temperature controlled case 100. Temperature controlled case 100 may have a number of doors (e.g., closed door case) or sliding panels. In other examples, temperature controlled case 100 may not have a door (e.g., open-case). The number of doors may allow selective access to within temperature controlled case 100. For example, access to within temperature controlled case 100 may be provided when a door is in an open position, and access to within temperature controlled case 100 may be prohibited when the door is in a closed position.

Shelves 110 may be mounted (e.g., secured, affixed, attached, etc.) to temperature controlled case 100 in a permanent manner (e.g., welded, riveted, integrated, etc.) or a removable manner (e.g., fastened, interlocked, interconnected, etc.). For example, shelves 110 may be fastened to temperature controlled case 100 through the use of fasteners (e.g., screws, bolts, etc.). In another example, shelves 110 may include prongs (e.g., protrusions, protuberances, studs, etc.) configured to interact with slots (e.g., channels, tracks, etc.) in temperature controlled case 100 such that shelves 110 may be interlocked to temperature controlled case 100. Shelves 110 may be of a solid, semi-solid, or mesh construction. For example, shelves 110 may be of a wire rack construction. Shelves 110 may be baskets such as wire baskets. Shelves 110 may include hooks or pegs for hanging various display products such as meats and cheese. Shelves 110 may be constructed of various materials such as aluminum, stainless steel, glass, tempered glass, frosted glass, wire, plastic, and other materials such that temperature controlled case 100 may be tailored for a target application. Shelves 110 may be coated and/or painted. For example, shelves 110 may be coated such that shelves 110 are resistant to frost buildup or other moisture buildup and/or painted to match a specific hex color code. Shelves 110 may be coated with a non-stick coating, a non-slip coating, an anti-microbial coating or other coating such that temperature controlled case 100 may be tailored for a target application.

Individually, air straighteners 140 may include a first beam, shown as support arm 150, and a first guide, shown as flow guide 160. In some embodiments, air straighteners 140 individually include flow guide 160. In other embodiments, air straighteners 140 individually include a number of flow guides 160. Air straighteners 140 may be mounted (e.g., secured, affixed, fastened, welded, attached, etc.) to shelves 110 in a permanent manner (e.g., welded, riveted, integrated, etc.) or a removable manner (e.g., fastened, interlocked, interconnected, etc.). For example, air straighteners 140 may be fastened to shelves 110 through the use of fasteners (e.g., screws, bolts, etc.). In another example, air straighteners 140 may include prongs (e.g., protrusions, protuberances, studs, etc.) configured to interact with slots (e.g., channels, tracks, holes, etc.) in shelves 110 such that air straighteners 140 may be interlocked to shelves 110. According to various embodiments, support arms 150 are configured to structurally couple air straighteners 140 to shelves 110. In other embodiments, support arms 150 are configured to structurally couple air straighteners 140 to temperature controlled case 100.

In various embodiments, temperature controlled case 100 includes a cooling system including a number of fans configured to discharge air from air-curtain discharge 120 and to receive air in air-curtain return 130. In operation, a first air flow, shown as air-curtain 170, flows between air-curtain discharge 120 and air-curtain return 130, and is defined by a travel between air-curtain discharge 120 and air-curtain return 130. According to various embodiments, air-curtain 170 originates at air-curtain discharge 120 and terminates at air-curtain return 130. As shown in the Figures, air-curtain 170 may be concentrated in a general area between air-curtain discharge 120 and air-curtain return 130. However, air-curtain 170 may not be entirely contained in the concentrated area. Accordingly, the depiction of air-curtain 170 is representative only of the concentrated area and not intended to depict a total confinement of air-curtain 170.

Similarly, while air-curtain 170 is depicted and generally described as flowing from air-curtain discharge 120 to air-curtain return 130, it is understood that other configurations are also possible. For example, air-curtain 170 may flow from air-curtain return 130 to air-curtain discharge 120. In some applications, temperature controlled case 100 may include a second air-curtain discharge in place of air-curtain return 130. In some embodiments, air-curtain discharge 120 is configured to discharge a second air-curtain in addition to air-curtain 170. For example, the second air-curtain may include air from air-curtain 170 that has exited air-curtain 170 as well as ambient air. In these embodiments, air straighteners 140 and/or flow guides 160 can be used to control the second air-curtain and/or air-curtain 170. In other embodiments, air-curtain return 130 is configured to discharge a second air-curtain in addition to air-curtain 170. For example, the second air-curtain may include air from air-curtain 170 that has exited air-curtain 170 as well as ambient air. In these embodiments, air straighteners 140 and/or flow guides 160 can be used to control the second air-curtain and/or air-curtain 170. Air-curtain 170 may have a temperature that is the same or different than the ambient environment. In application, displayed product may be placed on shelves 110. Shelves 110 may not facilitate placement of displayed product within air-curtain 170. Rather, in one embodiment, shelves 110 prohibit the placement of displayed product within air-curtain 170.

Air-curtain 170 may provide a protective barrier between a temperature controlled zone within temperature controlled case 100 and the ambient conditions outside of temperature controlled case 100. For example, the ambient conditions outside of temperature controlled case 100 may be of an undesired temperature and/or humidity (e.g., moisture content). In this case, air-curtain 170 may facilitate the preservation of the temperature controlled zone, having a different temperature and/or humidity than the ambient conditions outside of temperature controlled case 100. In some embodiments, support arms 150 include a number of air channels that are configured to facilitate the passage of air-curtain 170 through air straighteners 140.

A typical temperature controlled case may have an air-curtain having a travel between an outlet and an inlet and facilitating a partial barrier between controlled air (e.g., refrigerated air) and ambient air (e.g., outside air). The air-curtain of the typical temperature controlled case may become disorganized (e.g., chaotic, turbulent, etc.) along the travel due to turbulence, length of travel, and other factors. Accordingly, the air-curtain of the typical temperature controlled case may be subject to the introduction of ambient air into the air-curtain and the loss of controlled air from the temperature controlled case. The moisture content of the ambient air may be higher than that of the controlled air. As a result, the typical temperature controlled case may be subject to an increased refrigerant load and operate in an undesirable manner (e.g., inefficiently, ineffectively, etc.) due to the introduction of the ambient air. The introduction of the ambient air may additionally deposit moisture (e.g., water, ice, frost, etc.) on various locations and components of the typical temperature controlled case and result in an undesirable user experience with the typical temperature controlled case. For instance, a glass window of a door to the typical temperature controlled case may undesirably become obscured due to frost or fog prohibiting proper viewing of the contents within the typical temperature controlled case by the user. Similarly, water, frost, and/or ice may buildup on displayed products within the typical temperature controlled case. To account for these issues, many typical temperature controlled cases include larger fans which may be more energy consuming, expensive, and may produce more noise than the fans of temperature controlled case 100.

Advantageously, temperature controlled case 100 utilizes flow guides 160 to control air-curtain 170 from air-curtain discharge 120 to air-curtain return 130. Flow guides 160 may control air-curtain 170 by producing an effect, such as displacement, rotation, pressurization, depressurization, or other suitable effect on the air within air-curtain 170. As a result, air-curtain 170 is more effective at providing a barrier between the refrigerated zone of temperature controlled case 100 and the ambient environment, facilitating a lower refrigeration load and more desirable user experience compared to the typical temperature controlled case. Additionally, temperature controlled case 100 may be more efficient and/or effective than the typical temperature controlled case.

According to various embodiments, flow guides 160 are configured to control (e.g., direct, maintain, translate, rotate, pressurize, depressurize, etc.) air-curtain 170 at various points along the travel of air-curtain 170. For example, flow guides 160 may be placed on one or more shelves 110. In one example, temperature controlled case 100 may include four shelves 110 each individually having air straightener 140 and correspondingly flow guide 160. According to various embodiments, flow guides 160 are located at locations within air-curtain 170 and are configured to control air-curtain 170 at the locations within air-curtain 170. Flow guides 160 may be configured to maintain and insure the concentrated area of air-curtain 170 at various points along the travel of air-curtain 170.

Flow guides 160 may have various shapes and be of various sizes. For example, flow guides 160 may have a concave, a convex, or an air foil shape. Flow guides 160 may have one side that is flat, may be semi-symmetrical, or may be symmetrical. In other examples, flow guides 160 may have a straight or curved shape. Flow guides 160 may individually have an outside surface proximate the exterior of temperature controlled case 100 and an inside surface proximate the interior of temperature controlled case 100. In various embodiments, all of the surfaces of flow guides 160 are configured to have a low surface roughness. In some embodiments, the outside surfaces of flow guides 160 have different surface characteristics than the inside surfaces of flow guides 160. For example, the inside surfaces of flow guides 160 may have a lower surface roughness than the outside surfaces of flow guides 160.

In some applications, it may be desirable to utilize air straighteners 140 to provide additional capabilities to temperature controlled case 100. For example, air straighteners 140, support arms 150, and/or flow guides 160 may incorporate price tags, tickets, labels, markings, barcodes, stickers, or other product information such that temperature controlled case 100 may be tailored for a target application. The additional product information may be permanently or temporarily incorporated within air straighteners 140. In one embodiment, the outside surfaces of flow guides 160 include product information (e.g., price, barcode, descriptive information, etc.). In another embodiment, product information is suspended (e.g., attached, hung, etc.) from support arms 150. In one embodiment, product information is suspended (e.g., attached, hung, etc.) from air straighteners 140. Air straighteners 140, Support arms 150, and/or flow guides 160 may include retaining features configured to selectively secure product information. In some embodiments, the product information may be physically captured by air straighteners 140. In other embodiments, air straighteners 140 utilize a magnetic interface to retain the product information. In still other embodiments, air straighteners 140 include liquid crystal displays (LCDs). For example, air straighteners 140 may include LCDs on support arms 150 and/or flow guides 160. The retaining features may be protrusions, protuberances, clips, prongs, hooks, magnetic coupling points, vacuum coupling points (e.g., suction cups, etc.), Velcro®, hook and loop fasteners, or other suitable retaining features such that temperature controlled case 100 may be tailored for a target application. In some embodiments, support arms 150 are selectively repositionable (e.g., extendable, retractable, etc.) between a number of positions. For example, support arms 150 may be telescopic and/or adjustable such that flow guides 160 may be positioned at a number of locations.

Each air straightener 140, support arm 150, and/or flow guide 160 may individually be configured to incorporate information for a displayed product proximate air straightener 140, support arm 150, and/or flow guide 160. For example, shelf 110 may include two flow guides 160, the first flow guide 160 proximate a first displayed product and the second flow guide 160 proximate a second displayed product. According to this example, the first flow guide 160 may be configured to provide product information (e.g., a price tag, etc.) about the first displayed product and the second flow guide 160 may be configured to provide product information (e.g., a price tag, etc.) about the second displayed product. In some applications, air straighteners 140, support arms 150, and/or flow guides 160 may provide tactile information about a displayed product such as a product sample or Braille text.

In other applications, air straighteners 140, support arms 150, and/or flow guides 160 may be configured to be or to include visual display screens configured to provide visual product information. Air straighteners 140 may also provide additional lighting capabilities for temperature controlled case 100. The additional lighting capabilities may be permanently or temporarily incorporated within air straighteners 140. For example, air straighteners 140, support arms 150, and/or flow guides 160 may incorporate LEDs configured to illuminate the interior of temperature controlled case 100. The LEDs may be high-powered light-emitted diodes, LED arrays, organic light-emitted diodes (OLEDs), or other suitable light emitting devices, either alone or along with associated circuitry. The LEDs may be configured to illuminate a region above and/or below shelf 110. For example, the LEDs may provide illumination to displayed products on shelves 110.

In some applications, it may be desirable for air straighteners 140 to provide additional sensing capabilities to temperature controlled case 100. In these applications, support arms 150 and/or flow guides 160 may include various sensors configured to transmit information (e.g., data, readings, etc.) to temperature controlled case 100. For example, flow guides 160 may incorporate an air flow speed (e.g., mass air flow speed, MAF, etc.) sensor configured to monitor the speed of air-curtain 170. In another example, flow guides 160 may incorporate a temperature sensor configured to monitor the temperature of air-curtain 170. The additional sensing capabilities provided by air straighteners 140 may be utilized by temperature controlled case 100 to determine sensing data such as usage patterns, overall usage, energy loss and other pertinent sensing data such that temperature controlled case 100 may be tailored for a target application. In some applications, temperature controlled case 100 may utilize the sensing data to adjust air flow speed of air-curtain 170 and/or temperature of the interior of temperature controlled case 100. In other applications, temperature controlled case 100 may utilize the sensing data to determine maintenance needs or maintenance schedules for temperature controlled case 100.

Shelf 110 may include a continuous air straighter 140 or multiple air straighteners 140 spaced apart along the length of shelf 110. Accordingly, air straighteners 140 may be elongate. In one example, air straightener 140 is a continuous, thin strip along at least a portion of the length of shelves 110. Air straighter 140 may include a number of air channels configured to facilitate the transfer of air-curtain 170 through air straighter 140. The air channels may be rectangular, square, circular, triangular, hexagonal, and polygonal, a combination thereof, or any other suitable shape or combination of shapes such that air straightener 140 is tailored for a target application. In some applications, it may be desirable for the visual impact of air straighteners 140 to be a small as possible. Accordingly, air straighteners 140 may be a wire rod or may be constructed from at least partially clear (e.g., transparent, partially-transparent, translucent, etc.) plastic or other material.

In some applications, different shelves 110 may have different combinations of air straighteners 140 or flow guides 160. For example, a first shelf 110 may have a continuous air straightener 140 while a second shelf 110 may have more than one air straightener 140. In some applications, it may be desirable for air straightener 140 to incorporate more than one flow guide 160. Air straightener 140 may include two, three, four, or any number of flow guides 160. For example, air straightener 140 may include two flow guides 160. The flow guides 160 may cooperate to control air-curtain 170.

Flow guides 160 may be configured to be at an angle relative to a primary direction of air-curtain 170. The primary direction of air-curtain 170 may be a centerline of air-curtain 170. According to various embodiments, the primary direction of air-curtain 170 is substantially perpendicular to the mounting surface for temperature controlled case 100. The angle may be defined by the angular distance between the primary direction of air-curtain 170 and the portion of flow guide 160 proximate air-curtain return 130 where clockwise rotation is termed positive. In various embodiments, flow guides 160 are positioned substantially parallel (e.g., an angle of zero degrees) to the primary direction of air-curtain 170. In other embodiments, flow guides 160 are positioned at a positive angle relative to the primary direction of air-curtain 170. In one embodiment, flow guides 160 are positioned at a fifteen degree angle relative to the primary direction of air-curtain 170. In other embodiments, flow guides 160 are positioned at a negative angle relative to the primary direction of air-curtain 170. In one embodiment, flow guides 160 are positioned at a negative fifteen degree angle relative to the primary direction of air-curtain 170.

In some applications, it may be desirable to selectively reposition the angle of flow guides 160 relative to the primary direction of air-curtain 170. For example, flow guides 160 may be selectively repositionable between fifteen degrees relative to the primary direction of air-curtain 170 and negative fifteen degrees relative to the primary direction of air-curtain 170. In some embodiments, flow guides 160 are selectively repositionable between a number of angular positions. The angular positions that flow guides 160 are selectively repositionable in may include a position that is substantially parallel to a primary direction of the air-curtain. According to various embodiments, support arms 150 are substantially parallel to shelves 110. During the useful life of temperature controlled case 100, shelves 110 may be repositioned. Accordingly, in some embodiments, flow guides 160 are selectively repositionable to a number of locations that substantially correspond with a number of orientations of shelves 110. In one embodiment, air straightener 140 includes a plurality of detents configured to define positions of support arms 150 and/or flow guides 160.

According to a target application, support arms 150, flow guides 160, and shelves 110 may be constructed from various materials such as aluminum, stainless steel, glass, tempered glass, frosted glass, wire, plastic, and other materials such that temperature controlled case 100 is tailored for a target application. In various embodiments, support arms 150, flow guides 160, and shelves 110 are constructed from aluminum. According to various examples, support arms 150, flow guides 160, and shelves 110 may be made of the same or different materials. For example, shelves 110 and support arms 150 may be made of a metallic construction such as steel or aluminum while flow guides 160 may be made of a polymeric (e.g., plastic, etc.) construction. In some applications, it may be desirable to interchange flow guides 160. For example, in applications where flow guides 160 incorporate product information, different flow guides 160 may necessary if flow guides 160 are reconfigured. Similarly, in applications where flow guides 160 incorporate additional lighting capabilities, it may be desirable to remove, replace, and/or upgrade the additional lighting capabilities and in applications where flow guides 160 incorporate additional sensing capabilities, it may be desirable to remove, replace, and/or upgrade the additional sensing capabilities.

Temperature controlled case 100 may have a useful life. The useful life of temperature controlled case 100 may be defined as the period of time during which temperature controlled case 100 may be operational. In many applications, it may be desirable to have the ability to reconfigure temperature controlled case 100 at various points throughout the useful life of temperature controlled case 100. For example, a user of temperature controlled case 100 may initially configure temperature controlled case 100 to display dairy products, however, after observing higher demand for meat products, the user may wish to utilize temperature controlled case 100 to display meat products. According to various embodiments, shelves 110 and air straighteners 140 are reconfigurable by the user such that temperature controlled case 100 may be tailored for various applications. Similarly, different shelves 110, air straighteners 140, support arms 150, and/or flow guides 160 may be incorporated within temperature controlled case 100 in place of or in addition to shelves 110 and/or air straighteners 140 previously incorporated within temperature controlled case 100. For example, the user may wish to provide additional capabilities to temperature controlled case 100 by incorporating a basket style shelf 110 into temperature controlled case 100. In this example, the user may replace or supplement previously incorporated shelves 110.

In one embodiment, air straighteners 140 are selectively repositionable between a number of angles relative to the primary direction of travel of air-curtain 170. According to this embodiment, air straighteners 140 are repositionable when temperature controlled case 100 is reconfigured to provide necessary control of air-curtain 170. In one example, temperature controlled case 100 may have shelves 110 that are reconfigured from one angle relative to the mounting surface to another angle relative to the mounting surface. In order to account for this change, air straighteners 140 may be repositioned.

According to various embodiments, air straighteners 140 include gravity orientation mechanisms configured to orientate flow guides 160 such that flow guides 160 are perpendicular with a direction of gravity. In some embodiments, the gravity orientation mechanisms are mounted directly to flow guides 160. The gravity orientation mechanisms may utilize off-center axis of rotation (relative to air straighteners 140) such that flow guides 160 adjust due to the pull of gravity, with limiting features to set extents of rotation (e.g., fifteen degrees, etc.). The gravity orientation mechanism may be a weighted lever, cantilever beam, cam design, gyroscopic mechanism, or other mechanism configured to provide a constant orientation to an object. The direction of gravity may be substantially perpendicular to the mounting surface. The direction of gravity may be structurally limited by air straighteners 140 such that flow guides 160 may not be repositioned beyond a target location. In one application, temperature controlled case 100 may have shelves 110 that are reconfigured from an angle parallel with the mounting surface to a downward angle relative to the mounting surface, such as that used for meats. According to this application, air straighteners 140 including gravity orientation mechanisms may automatically orientate flow guides 160 such that flow guides 160 are parallel to the primary direction of air-curtain 170. According to various embodiments, the gravity orientation mechanism is configured to facilitate a constant orientation of flow guides 160 within air-curtain 170.

In some applications, it may be desirable for air straighteners 140 to be retrofit on typical temperature controlled cases. In this manner, the typical temperature controlled cases may be upgraded to an air-curtain similar to air-curtain 170. In some embodiments, air straighteners 140 and/or flow guides 160 can be releasably retained (e.g., snap fit, snapped on, clipped on, etc.) to shelves 110. Depending on the configuration of the typical temperature controlled case, various shelves of the typical temperature controlled case may be oriented at different angles relative to a primary mounting surface of the temperature controlled case. In these retrofit applications, air straighteners 140 may include a cam-track mechanism that is selectively repositionable between a number of fixed positions corresponding to a number of possible angular orientations of shelves 110.

In alternative examples, shelves 110 may include the cam-track mechanism rather than air straighteners 140. According to various embodiments, the cam-track mechanism is coupled to air straightener 140. In other embodiments, the cam-track mechanism is coupled to flow guides 160. In still other embodiments, the cam-track mechanism is coupled to shelves 110. The cam-track mechanism may facilitate a constant placement of flow guides 160 in the air-curtain of the typical temperature controlled case. For example, a shelf in the typical temperature controlled case may be oriented fifteen degrees from a horizontal plane parallel to the mounting surface. According to this example, the cam-track mechanism may allow air straighteners 140 to be selectively positioned to match the fifteen degree angular orientation of the shelf. Similarly, in some applications temperature controlled case 100 may have air straighteners 140 that include cam-track mechanisms. In these applications, shelves 110 may be repositioned similarly to the shelves of the typical temperature controlled case. According to various embodiments, the cam-track mechanism is configured to facilitate the selective repositioning of flow guide 160 within air-curtain 170.

Figure 2:
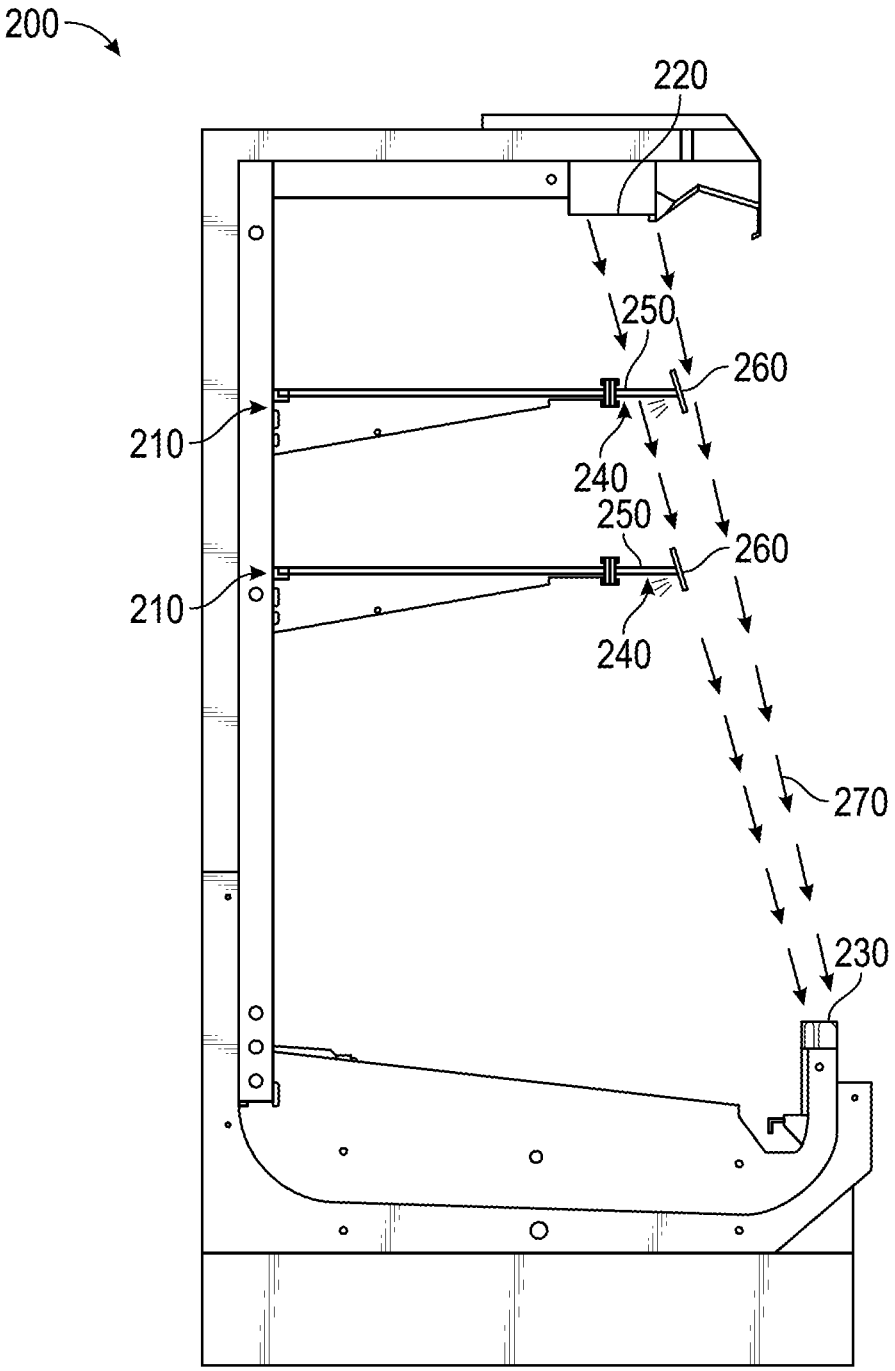
FIG. 2 is a side cross-sectional view of another temperature controlled case, according to an exemplary embodiment of the present disclosure.

As shown in FIG. 2, a second display case, shown as temperature controlled case 200 includes a second number of shelves, shown as shelves 210, a second air discharge, shown as air-curtain discharge 220, and a second air return, shown as air-curtain return 230. Individually, shelves 210 may include a second number of air straighteners, shown as air straighteners 240. Individually, air straighteners 240 may include a second beam, shown as support arm 250, and a second guide, shown as flow guide 260. Similar to air straighteners 140, air straighteners 240 may include a luminaire. In some embodiments, a luminaire is integrated into flow guide 260. In operation, a second air flow, shown as air-curtain 270, flows between air-curtain discharge 220 and air-curtain return 230, and is defined by a travel between air-curtain discharge 220 and air-curtain return 230. The primary direction of air-curtain 270 may be a centerline of air-curtain 270. It is understood that the foregoing description of temperature controlled case 100, shelves 110, air-curtain discharge 120, air-curtain return 130, air straighteners 140, support arms 150, flow guides 160, and air-curtain 170 similarly applies to and describes temperature controlled case 200, shelves 210, air-curtain discharge 220, air-curtain return 230, air straighteners 240, support arms 250, flow guides 260, and air-curtain 270, where similar symbols correspond to similar components.

Like air-curtain 170, air-curtain 270 may be partially defined by a concentrated area along a travel of air-curtain 270. Unlike air-curtain 170, the concentrated area of air-curtain 270 may fluctuate along the travel of air-curtain 270. Accordingly, it may be desirable to locate flow guides 260 at various locations within air-curtain 270, where the locations are defined relative to a primary direction of air-curtain 270 centered about the concentrated area of air-curtain 270. In application, the length of support arm 250 may be varied such that the location of flow guide 260 may be varied. For example, temperature controlled case 200 may include two shelves 210 each having air straighteners 240. In this example, air straighteners 240 of the first shelf 210 may have a longer support arm 250 than air straighteners 240 of the second shelf 210. In this manner, a larger span of air-curtain 270 may be controlled by flow guides 260 than if all support arms 250 had the same length and were located along the same location within air-curtain 270. Air straightener 240 may include gravity orientation mechanisms, similar to air straightener 140, or may employ a geometry that is configured to orient air straighter 240 in the primary direction of air-curtain 270 when temperature controlled case is in the normal operating condition. As air straighteners 240 and/or flow guides 260 are repositioned, the luminaires may be correspondingly repositioned such that shelves 210 remain illuminated.

Unlike air-curtain 170, the primary direction of air-curtain 270 may not be substantially perpendicular to a mounting surface for temperature controlled case 200. In one embodiment, the primary direction of air-curtain 270 is offset fifteen degrees from a line perpendicular to the mounting surface for temperature controlled case 200. Such orientation of air-curtain 270 is common for temperature controlled cases that display meat products.

Figure 3:
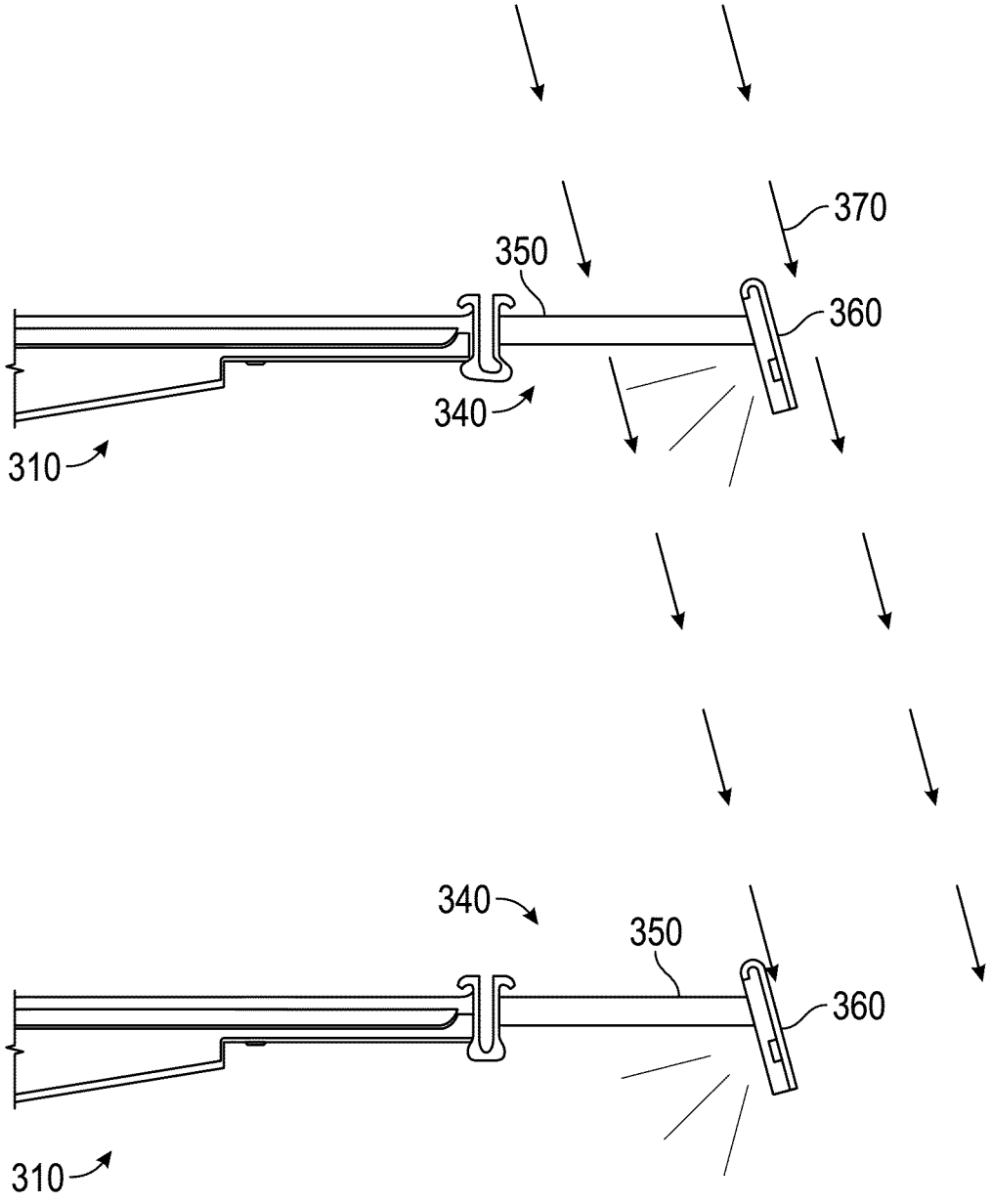
FIG. 3 is a detailed view of shelves for a temperature controlled case, each having an air straightener, according to an exemplary embodiment of the present disclosure.

Referring to FIG. 3, a number of shelves, shown as shelves 310, are shown individually coupled to air straighteners, shown as air straighteners 340. Air straighteners 340 are shown to individually include a beam, shown as support beam 350, and a guide, shown as flow guide 360. Air straighteners 340 are configured such that flow guides 360 are disposed in a region, shown as air-curtain 370. As particularly shown in FIG. 3, flow guides 360 may contain luminaires configured to illuminate particular shelves 310. For example, flow guide 360 mounted on a first shelf 310 may illuminate a second shelf 310 directly below the first shelf 310. Also shown in FIG. 3, flow guides 360 may be located at various locations within air-curtain 370 depending on the particular shelf 310 that flow guide 360 is coupled to. Depending on the location, flow guides 360 may have various effects on air-curtain 370. Similarly, depending on the location, luminaires within flow guides 360 may have various illumination effects on shelves 310.

Figure 4:
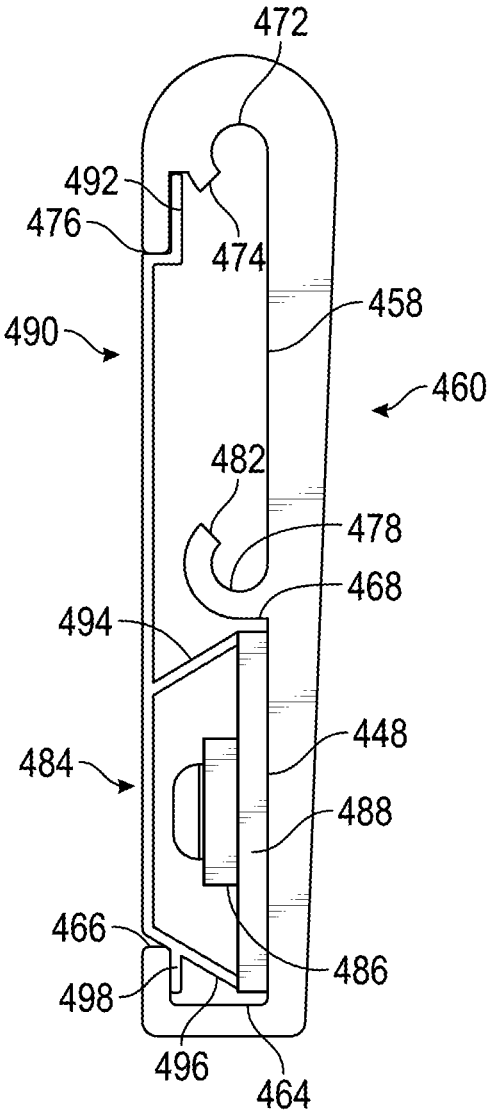
FIG. 4 is a detailed side view of a flow guide for a temperature controlled case, including a luminaire, according to an exemplary embodiment of the present disclosure.
Figure 5:
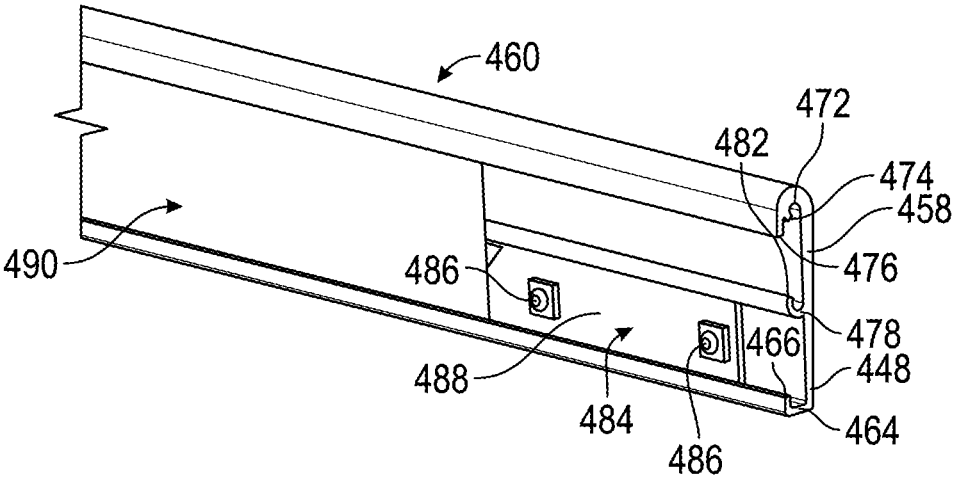
FIG. 5 is a perspective view of the flow guide shown in FIG. 4.

Referring now to FIGS. 4-5, a guide, shown as flow guide 460, includes a lighting module, shown as luminaire 484, that is electrically coupled to flow guide 460. Flow guide 460 may be electrically coupled to an air straightener and/or a temperature controlled case and configured to provide electrical power to luminaire 484. Flow guide 460 may be incorporated onto an air straightener (e.g., air straightener 140, air straightener 240, etc.) coupled to a shelf (e.g., shelf 110, shelf 210, etc.) and luminaire 484 may be configured to illuminate products (e.g., products 105, etc.) on the shelf. A top shelf of a temperature controlled case may be illuminated by luminaire 484, ambient light, and/or an auxiliary light positioned proximate a top cornice of the temperature controlled case. According to various embodiments, flow guide 460 includes a first channel (e.g., slot, recess, etc.), shown as lower channel 448, and a second channel (e.g., slot, recess, etc.), shown as upper channel 458. Lower channel 448 may include a wall, shown as lower wall 464, an edge, shown as bottom retaining edge 466, and a wall, shown as middle wall 468. Upper channel 458 may include a groove (e.g., channel, slot, etc.), shown as upper groove 472, an edge, shown as upper edge 474, another edge, shown as top retaining edge 476, another groove (e.g., channel, slot, etc.), shown as lower groove 478, and another edge, shown as middle edge 482. Luminaire 484 may include a number of illumination elements (e.g., light, lamp, etc.), shown as LEDs 486, and a circuit board, shown as printed circuit board (PCB) 488. LEDs 486 and PCB 488 may be electrically coupled to luminaire 484, and thereby to flow guide 460. Flow guide 460 may further include a cover (e.g., shield, etc.), shown as lens 490. Lens 490 may include an edge, shown as upper lens edge 492 (e.g., upper edge, lens edge, etc.), a projection (e.g., protuberance, etc.), shown as upper leg 494, another projection, shown as lower leg 496, and another edge, shown as lower lens edge 498 (e.g., lower edge, lens edge, etc.).

According to various embodiments, luminaires 484 facilitate a lower temperature of products in a temperature controlled case compared to a typical temperature controlled case. Luminaire 484 may facilitate illumination of products along the entire length of various shelves in a temperature controlled case. In some embodiments, luminaires 484 facilitate uniform placement of products on shelves. Further, luminaires 484 may facilitate increased storage capacity of the shelves compared to shelves of a typical temperature controlled case. For example, typical temperature controlled cases may utilize a tiered scheme when determining lengths of multiple shelves in the typical temperature controlled case. For example, the typical temperature controlled case may have a top shelf, a middle shelf with a length greater than the length of the top shelf, and a bottom shelf with a length greater than the length of the middle shelf. This tiered scheme results in less than optimal capacity, utilization, and efficiency of the typical temperature controlled case.

In various embodiments, luminaire 484 is coupled to lower channel 448 and lower channel 448 is configured to receive PCB 488. In some embodiments, an interface between PCB 488 and lower channel 448 includes thermal grease (e.g., CPU grease, heat paste, heat sink compound, thermal paste, etc.). The thermal grease may be configured to increase heat transfer between PCB 488 and flow guide 460. In some applications, PCB 488 is secured to lower channel 448 through the use of an adhesive (e.g., glue, epoxy, etc.). In other applications, PCB 488 is secured to lower channel 448 through the use of fasteners (e.g., screws, bolts, etc.) and/or retaining clips. PCB 488 may be defined by a length, a width less than the length, and a thickness less than the width. The length of PCB 488 may be less than the length of flow guide 460. The width of PCB 488 may be less than the distance from lower wall 464 to middle wall 468. The thickness of PCB 488 may be less than the distance between bottom retaining edge 466 and lower channel 448. However, the distance between bottom retaining edge 466 and lower channel 448 may be sized to receive PCB 488. According to various embodiments, PCB 488 is retaining within lower channel 448 through a force exerted by a combination of upper leg 494 and lower leg 496 on PCB 488. For example, upper leg 494 and lower leg 496 may cause PCB 488 to be in contact with lower channel 448. Upper leg 494 and lower leg 496 may have an un-deformed shape when lens 490 is not installed in flow guide 460 containing PCB 488. When installed in flow guide 460 containing PCB 488, upper leg 494 and/or lower leg 496 may have a deformed shape and may individually exert a force on PCB 488 biasing PCB 488 against lower channel 448 due to a difference between the un-deformed shape and the deformed shape of upper leg 494 and/or lower leg 496.

According to various embodiments, lens 490 is coupled to flow guide 460 through an interaction between lower lens edge 498 and bottom retaining edge 466 and an interaction between upper lens edge 492 and top retaining edge 476. In some embodiments, an interaction between upper edge 474 and upper lens edge 492 assists in coupling lens 490 to flow guide 460. An interaction between upper leg 494 and PCB 488 and an interaction between lower leg 496 and PCB 488 may assist in coupling lens 490 to flow guide 460.

Flow guide 460 may be coupled to a shelf (e.g., shelf 110, shelf 210, etc.) of a temperature controlled case (e.g., temperature controlled case 100, temperature controlled case 200, etc.) through the use of a support arm (e.g., support arm 150, support arm 250, etc.) of an air straightener (e.g., air straightener 140, air straightener 240, etc.) coupled to the shelf and to flow guide 460. In some applications, multiple support arms are used to couple flow guide 460 to the shelf. In various embodiments, the support arm may couple to flow guide 460 through the interaction of the support arm with upper channel 458, upper groove 472, lower groove 478, upper edge 474, and middle edge 482. In some embodiments, the support arm may be slidably engaged with upper channel 458, lower groove 478, and upper groove 472. While the support arms may be coupled to upper channel 458 and luminaire 484 may be coupled to lower channel 448, it is understood that the support arms may be coupled to lower channel 448 and luminaire 484 may be coupled to upper channel 458. According to various embodiments, flow guide 460 is coupled to a support arm through the insertion of fasteners through the support arm and into upper groove 472 and lower groove 478. In some embodiments, upper groove 472 and lower groove 478 are threaded and configured to receive a threaded fastener (e.g., bolt, screw, etc.). In other embodiments, upper groove 472 and/or lower groove 478 include a threaded post configured to be inserted into holes in the support arm. In this embodiment, the support arm is coupled to the upper groove 472 and/or lower groove 478 through the use of a nut on the threaded post.

According to various embodiments, multiple flow guides 460 may be utilized on a temperature controlled case (e.g., temperature controlled case 100, temperature controlled case 200, etc.). For example, a temperature controlled case may include an air straightener for every shelf, and have flow guides 460 individually mounted to every air straightener. Flow guides 460 may have a length corresponding to a length of a shelf that the flow guide 460 is coupled to. For example, if a shelf that flow guide 460 is coupled to has a length of two meters, flow guide 460 may have a length of substantially two meters. In other examples, multiple flow guides 460 may be coupled to the same shelf. For example, along the length of the shelf, a first flow guide 460 may only occupy a certain section of the shelf while a second flow guide 460 occupies a different section of the shelf. Further, shelves may contain portions without flow guides 460.

In some examples, PCB 488 may have a length less than or equal to a length of flow guide 460. For example, flow guide 460 may contain multiple PCBs 488. In one example, flow guide 460 contains one PCB 488 with a length substantially equal to a length of flow guide 460. Further, flow guide 460 may contain portions without PCB 488. In various embodiments, LEDs 486 are coupled to PCB 488 and disposed along the length of PCB 488 at regular intervals (e.g., every five centimeters, every ten centimeters, etc.). For example, for a particular PCB 488 having a length of forty-eight centimeters, forty-six LEDs 486 may be coupled to PCB 488 at regular intervals of two centimeters. Similarly, irregular or varying intervals between LEDs 486 may be utilized. In one example, PCB 488 may be defined by a first end section, a middle section, and a second end section. Following this example, a spacing between LEDs 486 in the middle section may be smaller than a spacing between LEDs 486 in either the first end section or the second end section. Further, some portions of PCB 488 may not have any LEDs 486.

Depending on the application, PCB 488 may incorporate surface-mount devices (SMDs) in addition to LEDs 486. SMDs may be resistors, capacitors, diodes, rectifiers, fans, heat sinks, transistors, multi discrete modules, voltage suppressors, processors, memory units, thyristors, and other electronic devices such that PCB 488 may be tailored for a target application. PCB 488 may be defined as having a frontal surface in confronting relation with lower channel 448 or upper channel 458, and a rear surface opposite the frontal surface and proximate lens 490. In some examples, PCB 488 may contain LEDs 486 and other surface-mount devices (SMDs) only the rear surface of PCB 488 directed towards products on a shelf. According to these examples, the frontal surface of PCB 488 may not contain LEDs 486 or SMDs. In other examples, PCB 488 contains LEDs 486 and/or other SMDs on both the frontal surface and the rear surface of PCB 488. Other SMDs that could be included on PCB 488 include capacitors, resistors, wiring, heat sinks, display screens, potentiometers, etc.

In some applications, flow guide 460 may be configured to be aesthetically pleasing. Flow guides 460 may be defined as having an interior lateral surface proximate products in a temperature controlled case, and an exterior lateral surface opposite the interior lateral surface. In some embodiments, the exterior lateral surface of flow guides 460 is configured to substantially cover LEDs 486, PCB 488, and all other SMDs. For example, while LEDs 486 may illuminate products, LEDs 486, PCB 488 and all other SMDs may not be directly observed by a customer when a temperature controlled case is in use. In one embodiment, luminaires 484 are configured such that a customer viewing an air straightener having luminaire 484 from outside of a temperature controlled case may not directly see LEDs 486. The configuration of luminaires 484 may reduce glare experienced by customers during use of a temperature controlled case compared to lighting elements of a typical temperature controlled case.

In some applications, shelves of a temperature controlled case are of different lengths (e.g., fifty centimeters, fifty-six centimeters, sixty-one centimeters, etc.). Luminaires 484 may advantageously facilitate adequate lighting of products on each of the shelves such that a front face of products displayed on the shelves may readily be visible by a customer.

In various embodiments, luminaires 484 have an illumination target. The illumination target may correspond to a desired location of illumination (e.g. lighting, visibility, etc.), such as an arrangement of products on a particular shelf. For example, it may be desirable to be able to clearly see products located on a rearward portion of the shelf. The illumination target may be a concentration (e.g., area, etc.) of illumination emitted (e.g., produced, dispersed, etc.) from LEDs 486. For example, LEDs 486 may be focused (e.g., directed, concentrated, etc.) on the illumination target. Luminaires 484 may have a pre-set illumination target or may have an illumination target that is selectively repositionable. For example, the illumination target may be a row of products on a particular shelf directly below a particular air straightener having luminaire 484. Depending on the length of the particular shelf, luminaire 484 may need to be repositioned, or interchanged with a different luminaire 484. For example, the air straightener may allow luminaire 484 to be selectively repositioned (e.g., through movement of a support arm or flow guide). In another example, luminaire 484 may be selectively repositionable within flow guide 460. For example, luminaire 484 may be selectively repositionable along lower channel 448. However, in some applications it may be more desirable to interchange luminaire 484 with a different luminaire having a different illumination target. For example, one luminaire 484 may produce an illumination target that corresponds to a length of a shelf of approximately fifty centimeters while another luminaire 484 may produce an illumination target that corresponds to a length of a shelf of approximately fifty-six centimeters.

In some applications, luminaires 484 may be mounted to shelves of a temperature controlled case without the use of air straighteners. Rather, luminaires 484 may be mounted to shelves of the temperature controlled case through the use of mounting hardware. The mounting hardware may be a number of brackets configured to couple luminaires 484 to shelves of the temperature controlled case and fasteners to secure the brackets thereto.

According to one application, a temperature controlled case may have a first shelf having a first air straightener and a first luminaire 484, a second shelf having a second air straightener and a second luminaire 484, and a third shelf having a third air straightener and a third luminaire 484. According to this application, the first luminaire 484 may be configured to illuminate products on the second shelf and the second luminaire 484 may be configured to illuminate products on the third shelf. In other examples, an illumination target may be products on the particular shelf directly above a particular air straightener having luminaire 484. In some other examples, luminaire 484 may have multiple illumination targets. In these examples, individual LEDs 486 may individually have an illumination target. It is understood that wherein an illumination target of luminaire 484 is described it is similarly an illumination target of at least an individual LED 486. Similarly, it is understood that an illumination target of LEDs 486 is an illumination target of luminaire 484. In one example, luminaire 484 may be configured to have multiple illumination targets on a number of shelves above and/or below luminaire 484. In an application where luminaires 484 individually have two illumination targets, luminaires 484 may individually contain a first number of LEDs 486 having a first illumination target and a second number of LEDs 486 having a second illumination target different from the first illumination target. In other examples, LEDs 486 may individually have multiple illumination targets. For example, LEDs 486 on a first shelf may illuminate products on the first shelf and products on a second shelf below the first shelf. In another example, LEDs 486 on a first shelf may illuminate products on a second shelf below the first shelf and a third shelf below the first shelf. In yet another example, LEDs 486 on a first shelf may illuminate products on a second shelf above the first shelf. In an alternative example, luminaire 484 may be configured to illuminate products on the shelf to which the air straightener having luminaire 484 is coupled.

In one embodiment, air straighteners (e.g., air straighteners 140, air straighteners 240, etc.) of a temperature controlled case are selectively repositionable between a number of angles relative to the primary direction of travel of an air-curtain (e.g., air-curtain 170, air-curtain 270, etc.). According to this embodiment, the air straighteners are repositionable when temperature controlled case 100 is reconfigured to provide necessary control of the air-curtain. In other embodiments, the air straighteners, flow guides (e.g., flow guides 460) and/or luminaires 484 are reconfigurable such that an illumination target of LEDs 486 may be selectively repositioned. In one example, a temperature controlled case may have shelves that are reconfigured from one angle relative to the mounting surface to another angle relative to the mounting surface. In order to account for this change, the air straighteners may be repositioned. Further, when shelves are reconfigured, it may be desirable to relocate the illumination target of LEDs 486. Accordingly, the air straighteners and/or luminaires 484 may be reconfigured such that an illumination target of LEDs 486 is located in a desired location (e.g., a front face of a product, etc.).

Depending on the configuration of a temperature controlled case, various shelves of the temperature controlled case may be oriented at different angles relative to a primary mounting surface of the temperature controlled case. In these applications, luminaires 484 and/or air straighteners may be repositioned such that products (e.g., products 105) are adequately illuminated. In some applications, it may be desirable to reconfigure a temperature controlled case thereby changing an angle of a shelf. According to an embodiment where the reconfigured temperature controlled case include luminaires 484, luminaires 484 may be selectively repositioned such that the illumination targets of luminaires 484 correspond with new locations of the shelves.

According to various embodiments, flow guides 460 are configured to provide cooling and heat dissipation to luminaires 484. In one embodiment, flow guides 460 resemble a heat sink (e.g., pin fin, straight fin, flared fine, etc.). In order to facilitate heat dissipation, flow guides 460 may be painted (e.g., black) or coated such that heat dissipation is maximized. In some embodiments, flow guides 460 may be placed in a portion of an air-curtain (e.g., air-curtain 170, air-curtain 270, etc.) in confronting relation with ambient air (e.g., air from outside of a temperature controlled case). In these embodiments, heat from luminaire 484 may be transition from luminaire 484 to flow guide 460 through the air-curtain and into the ambient environment. These embodiments may facilitate increased temperature reduction of the air-curtain while luminaires 484 are utilized.

In some applications, it may be desirable for flow guides 460 and/or luminaires 484 to be retrofit on typical temperature controlled cases having air straighteners. In this manner, the typical temperature controlled cases may facilitate increased illumination of products on shelves providing for a more desirable temperature controlled case. For example, a previous air straightener may be removed and a new air straightener having luminaire 484 may be installed. Similarly, flow guides of a previous air straightener may be removed and replaced with flow guides 460 individually having luminaire 484. In other applications, luminaires 484 may be individually retrofit into previous air straighteners. In some embodiments, luminaires 484 are releasably retained (e.g., snap fit, snapped on, clipped on, etc.) to air straighteners and/or flow guides (e.g., flow guides 460, etc.). In other embodiments, luminaires are fastened to air straighteners and/or flow guides.

According to various embodiments, it may be desirable to replace and/or upgrade various components of luminaire 484. In one example, it may be desirable to increase the intensity of light provided by luminaire 484. According to this example, a user may remove luminaire 484 from flow guide 460 and reinsert a new luminaire 484 configured to provide the desired intensity of light within flow guide 460. The user may remove luminaire 484 by first removing lens 490. After removing lens 490, the user may slide luminaire 484 out of flow guide 460. Alternatively, removing lens 490 may allow the user to rotate luminaire 484 out from lower channel 448. In some applications, it may be possible to individually replace and/or upgrade LEDs 486. In these applications, a user may remove luminaire 484 from flow guide 460, and may interchange current LEDs 486 for new LEDs 486. The user may utilize similar processes to replace and/or upgrade PCB 488.

In some applications, luminaires 484 may be configured to provide illumination targets in a certain location defined by an angle and distance from flow guide 460. According to these applications, when reconfiguring a temperature controlled case containing luminaires 484, it may be desirable to replace luminaires 484 with different luminaires 484 having illumination targets corresponding with new locations of the shelves of the temperature controlled case. In some applications, one or more support arms of an air straightener having luminaires 484 may have a telescoping mechanism configured to selectively alter the length of the support arm(s). In these applications, the illumination target of luminaires 484 may be altered by selectively changing the length of the support arm(s).

When reconfiguring a temperature controlled case it may be desirable to change the color of LEDs 486. In these applications, previous LEDs 486 may be replaced with LEDs 486 having a more desirable color. As technology advances, it may be desirable to replace luminaire 484 with a luminaire 484 having a higher efficiency and/or providing increased capabilities. For example, luminaire 484 may be configured to utilize LEDs 486 that are ultra violet. In addition to luminaire 484, lens 490 may also be replaced and/or upgraded. For example, luminaire 484 may initially have a clear (e.g., transparent, etc.) lens 490. However, after a period of time, it may be more desirable for luminaire 484 to utilize a frosted (e.g., translucent, etc.) lens 490. Accordingly, the clear lens 490 may be removed from flow guide 460 and the frosted lens 490 may be installed in flow guide 460.

While not explicitly shown, it is understood that luminaires 484 may incorporate additional electronic technology necessary and desirable for the operation of LEDs 486 and/or PCBs 488. For example, electrical wiring may electrically couple luminaires 484 to a temperature controlled case and further to a power grid. Luminaires 484 may also be coupled to an LED driver, load resistor, and/or an auxiliary power supply. Luminaires 484 may include sensors (e.g., temperature sensors, humidity sensors, air flow sensors, motion sensor, illumination sensors, etc.) and/or an electrical consumption meter (e.g., watt-hour meter, etc.). In one example, luminaires 484 include illumination sensors that modulate output of luminaires 484 according to ambient lighting conditions. It is understood that luminaires 484 may also contain additional capabilities. For example, luminaires 484 may have an energy conservation (e.g., energy saving, sleep, etc.) mode. In the energy conservation mode, luminaires 484 may be configured to provide no or minimal illumination, thereby consuming little electrical power. Luminaires 484 may enter energy conservation mode after a programmed time (e.g., when the store closes, etc.) or after a period of time since the last use of the temperature controlled case. The use of the temperature controlled case may be monitored by a motion sensor.

In some examples, luminaires 484 may be controlled directly on a temperature controlled case (e.g., through the use of a button, touch pad, etc.). In other examples, luminaires 484 may be controlled by a control device isolated from luminaires 484. In some examples, luminaires 484 of multiple temperature controlled cases may be controlled by a control device isolated from any of luminaires 484. For example, luminaires 484 may wirelessly transmit a status (e.g., on, off, energy conservation mode, repair needed, etc.), parameters (e.g., energy consumption, illumination output, operating temperature, etc.), and sensor data (e.g., temperature inside the temperature controlled case, air speed of an air-curtain, humidity, usage, ambient lighting conditions, etc.) to the control device. The control device may be a web application that may be accessed through an application on a mobile device (e.g., phone, tablet, etc.) or a computer (e.g., laptop, desktop, etc.).

In various embodiments, flow guide 460 is constructed from extruded aluminum. In other embodiments, flow guide 460 is constructed from plastic or a polymeric compound or blend. For example, flow guide 460 may be constructed from unfilled plastic or glass-filled plastic. Similarly, lens 490 may be constructed from plastic or a polymeric compound or blend. In some embodiments, lens 490 is constructed from a resin. In an alternative embodiment, lens 490 is constructed from glass (e.g., tempered, frosted, etc.).

According to various embodiments, PCB 488 may be a printed circuit board having a metal substrate. The metal substrate may be aluminum, aluminum clad, aluminum base, metal clad, insulated metal substrate, and/or thermally conductive. The metal substrate may provide increased heat transfer. PCB 488 may be flexible. In other embodiments, PCB 488 may be a printed circuit board having a FR-4 (e.g., glass-reinforced epoxy) substrate. Additionally, LEDs 486, PCB 488 and flow guide 460 may include plated metal vias (e.g., through hole, blind, buried, etc.) thereby increasing heat transfer from luminaire 484.

While luminaire 484 has been shown as described to use surface-mount-technology and SMDs, it is understood that through-hole style components, devices, and circuit boards could similarly be used. For example, PCB 488 may be replaced with a through-hole style circuit board. In this case, flow guide 460 may be constructed from an insulating material (e.g., plastic, etc.) to prevent shorting of any soldered connections.

Figure 6:
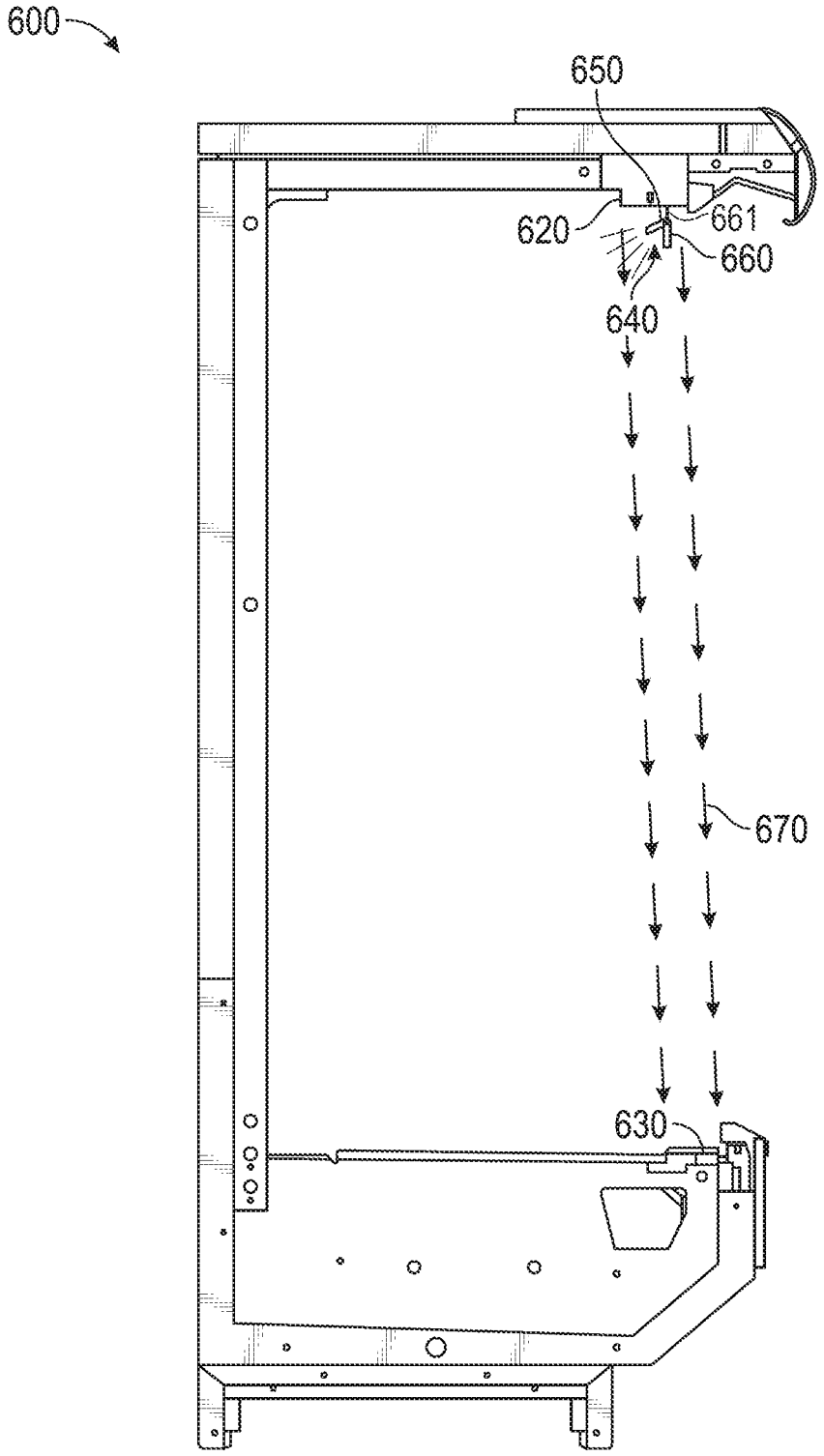
FIG. 6 is a side cross-sectional view of another temperature controlled case, according to an exemplary embodiment of the present disclosure.

Referring to FIG. 6, a third display case, shown as temperature controlled case 600 includes a third air discharge, shown as air-curtain discharge 620, a third air return, shown as air-curtain return 630, and a third air straightener, shown as air straightener 640. Air straightener 640 may include a third beam, shown as support arm 650, and a third guide, shown as flow guide 660. In operation, a third air flow, shown as air-curtain 670, flows between air-curtain discharge 620 and air-curtain return 630, and is defined by a travel between air-curtain discharge 620 and air-curtain return 630. The primary direction of air-curtain 670 may be a centerline of air-curtain 670. It is understood that the foregoing description of temperature controlled case 100, air-curtain discharge 120, air-curtain return 130, air straighteners 140, support arms 150, flow guides 160, air-curtain 170, temperature controlled case 200, air-curtain discharge 220, air-curtain return 230, air straighteners 240, support arms 250, flow guides 260, air-curtain 270, and flow guides 460 similarly applies to and describes temperature controlled case 600, air-curtain discharge 620, air-curtain return 630, air straightener 640, support arm 650, flow guide 660, and air-curtain 670, where similar symbols correspond to similar components.

Temperature controlled case 600 may not include any shelves. Temperature controlled case 600 may be desirable for display products such as deli meats and cheeses, stacked boxes (e.g., beverage containers, etc.), bulk produce displays, floral arrangement displays, arrays of vases, and other suitable display products such that temperature controlled case 600 may be tailored for a target application. In one embodiment, temperature controlled case 600 includes a peg-hook display configured to facilitate the hanging of display products. According to various embodiments, air straightener 640 is mounted to temperature controlled case 600. For example, air straightener 640 may be suspended from a rod, wire 661, or support arms 650 attached to temperature controlled case 600. Unlike air straighteners 140 and air straighteners 240, air straighter 640 may not be mounted to a shelf. According to various embodiments, a luminaire, such as luminaire 484, mounted within flow guide 660 may have multiple LEDs, such as LEDs 486, such that multiple or large illumination targets are possible.

According to various embodiments, flow guide 660 is made from at least partially clear (e.g., transparent, partially-transparent, translucent, etc.) plastic or other material. In one embodiment, flow guide 660 is a metal strip. In addition to or in replace of the capabilities of air straighteners 140, air straightener 640 may have rotational capability such that air straightener 640 is within air-curtain 670 under a normal operating condition but is removed from air-curtain 670 when temperature controlled case 600 is in use by a user. For example, air straightener 640 may be rotatable within a joint such that air straightener 640 may be rotated by a slight force transmitted by an object such as display product being loaded into or unloaded from temperature controlled case 600. According to various embodiments, air straightener 640 includes a luminaire similar to luminaire 484 configured to illuminate the inside of temperature controlled case 600. Similar to air straightener 140, air straightener 640 may be selectively repositionable. Air straightener 640 may include gravity orientation mechanisms, similar to air straightener 140, or may employ a geometry that is configured to orient air straighter 640 in the primary direction of air-curtain 670 when temperature controlled case 600 is in the normal operating condition. In this manner, air straightener 640 may be protected from inadvertent damage throughout use of temperature controlled case 600. In another example, air straightener 640 may be coupled to a device (e.g., motor, solenoid, linear actuator, actuator, etc.) configured to rotate air straightener 640 to a stored position when temperature controlled case 600 is in use as detected by, for example, a sensor or switch located on or within temperature controlled case 600. Air straightener 640 may be angularly displaced relative to air-curtain 670. For example, air straightener 640 may be angled fifteen degrees towards or away from a door of temperature controlled case 600.

In some applications, it may be desirable to provide the functionality of temperature controlled case 600 to a typical temperature controlled case. Due to the simplicity of air straightener 640, it may be possible to retrofit air straightener 640 on a variety of makes and models of typical temperature controlled cases in the field (e.g., at a supermarket, etc.). Accordingly, air straightener 640 may be readily retrofit on typical temperature controlled cases such that the added functionality of air straightener 640 may be provided to the typical temperature controlled cases.

Figure 7:
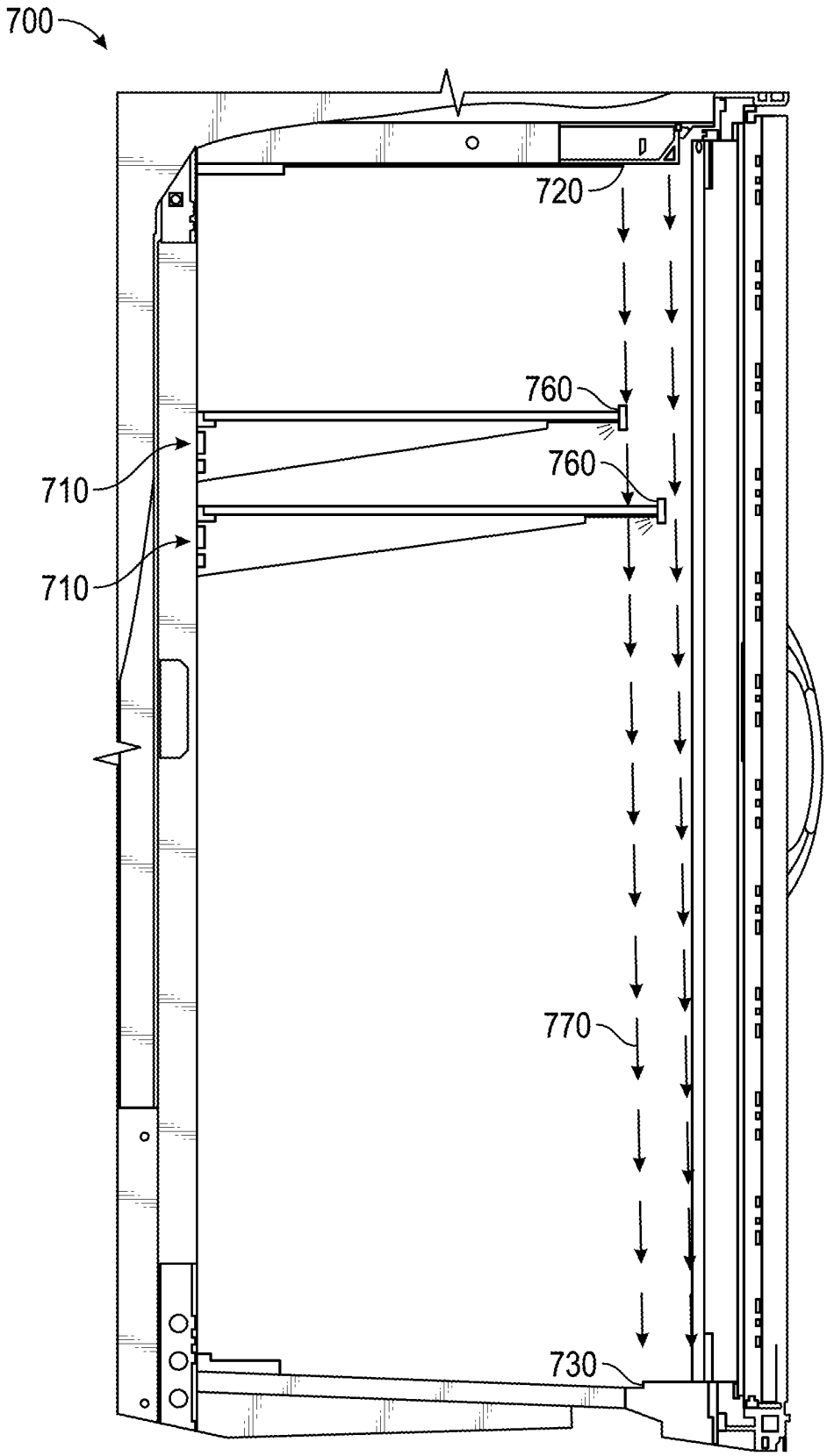
FIG. 7 is a side cross-sectional view of another temperature controlled case, according to an exemplary embodiment of the present disclosure.

As shown in FIG. 7, a fourth display case, shown as temperature controlled case 700 includes a third number of shelves, shown as shelves 710, a fourth air discharge, shown as air-curtain discharge 720, and a fourth air return, shown as air-curtain return 730. Individually, shelves 710 may include a fourth guide, shown as flow guide 760. In operation, a fourth air flow, shown as air-curtain 770, flows between air-curtain discharge 720 and air-curtain return 730, and is defined by a travel between air-curtain discharge 720 and air-curtain return 730. The primary direction of air-curtain 770 may be a centerline of air-curtain 770. Temperature controlled case 700 may include a door proximate flow guides 760. It is understood that the foregoing description of temperature controlled case 100, air-curtain discharge 120, air-curtain return 130, air straighteners 140, support arms 150, flow guides 160, air-curtain 170, temperature controlled case 200, shelves 210, air-curtain discharge 220, air-curtain return 230, air straighteners 240, support arms 250, flow guides 260, air-curtain 270, flow guide 460, temperature controlled case 600, air-curtain discharge 620, air-curtain return 630, air straightener 640, support arm 650, flow guide 660, and air-curtain 670 similarly applies to and describes temperature controlled case 700, shelves 710, air-curtain discharge 720, air-curtain return 730, flow guides 760, and air-curtain 770, where similar symbols correspond to similar components.

In some applications, it may be desirable to incorporate an air straightening design directly into shelves 710 of temperature controlled case 700. Accordingly, temperature controlled case 700 includes flow guides 760 disposed along one edge of shelves 710. In one embodiment, shelf 710 is configured to receive flow guide 760 along one edge of shelf 710. Shelves 710 may include holes configured to facilitate the transfer of air-curtain 770 through shelves 710. In one embodiment, shelves 710 and flow guides 760 cooperate to extend air-curtain 770 at a target location proximate shelves 710. In various applications, shelves 710 may be of differing lengths such that flow guides 760 are located at various locations within air-curtain 770. Accordingly, flow guides 760 and shelves 710 may cooperate to control air-curtain 770 at various locations within air-curtain 770. In some embodiments, temperature controlled case 700 includes one type of flow guide 760 on one shelf 710 and another type of flow guide 760 on another shelf 710. According to this embodiment, the first type of flow guide 760 produces a first effect on air-curtain 770 and the second type of flow guide 760 produces a second effect on air-curtain 770 that may be different from the first effect. Flow guides 760 may be a leading edge of shelf 710, a channel or flange, or any other suitable structure such that temperature controlled case 700 may be tailored for a target application. Flow guides 760 may incorporate price tags, product information, bar codes, or other components.

As shown in FIG. 7, shelves 710 are of different lengths. Accordingly, flow guides 760 may incorporate luminaires, similar to luminaires 484. In this manner, flow guides 760 may adequately illuminate products on shelves 710. Each flow guide 760 may have a luminaire configured to illuminate a particular shelf 710.

Flow guides 760 may be angled at any angle relative to a mounting surface for temperature controlled case 700. In one embodiment, flow guides 760 are angled substantially perpendicular to the mounting surface for temperature controlled case 700. In other examples, flow guides 760 are angled towards or away from the door of temperature controlled case 700. In some applications, it may be desirable for the angle of flow guides 760 to substantially match the angle of air-curtain 770, such that flow guides 760 are oriented substantially parallel to the primary direction of air-curtain 770. For example, flow guides 760 may be angled fifteen degrees from the primary direction of air-curtain 770 towards the door. In various embodiments, flow guides 760 are selectively repositionable between a number of fixed angular positions. In some embodiments, flow guides 760 are integrated within shelves 710. In other embodiments, flow guides 760 are selectively removable and replaceable from shelves 710. According to these embodiments, a user can change the control of air-curtain 770 simply by interchanging flow guide 760 with a different flow guide 760.

Figure 8:
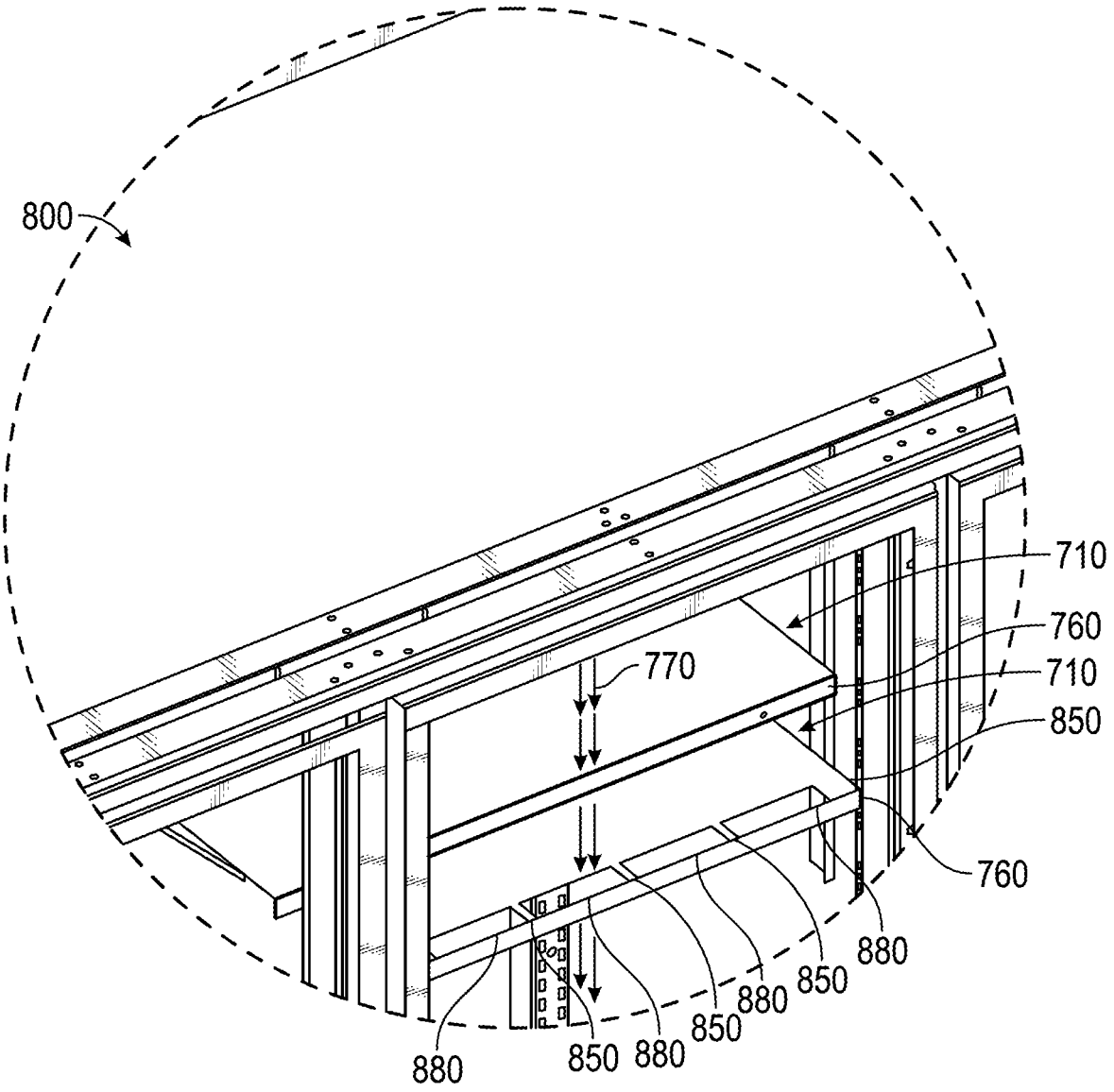
FIG. 8 is a top perspective view of a number of temperature controlled cases, including the temperature controlled case shown in FIG. 7, according to an exemplary embodiment of the present disclosure.
Figure 9:
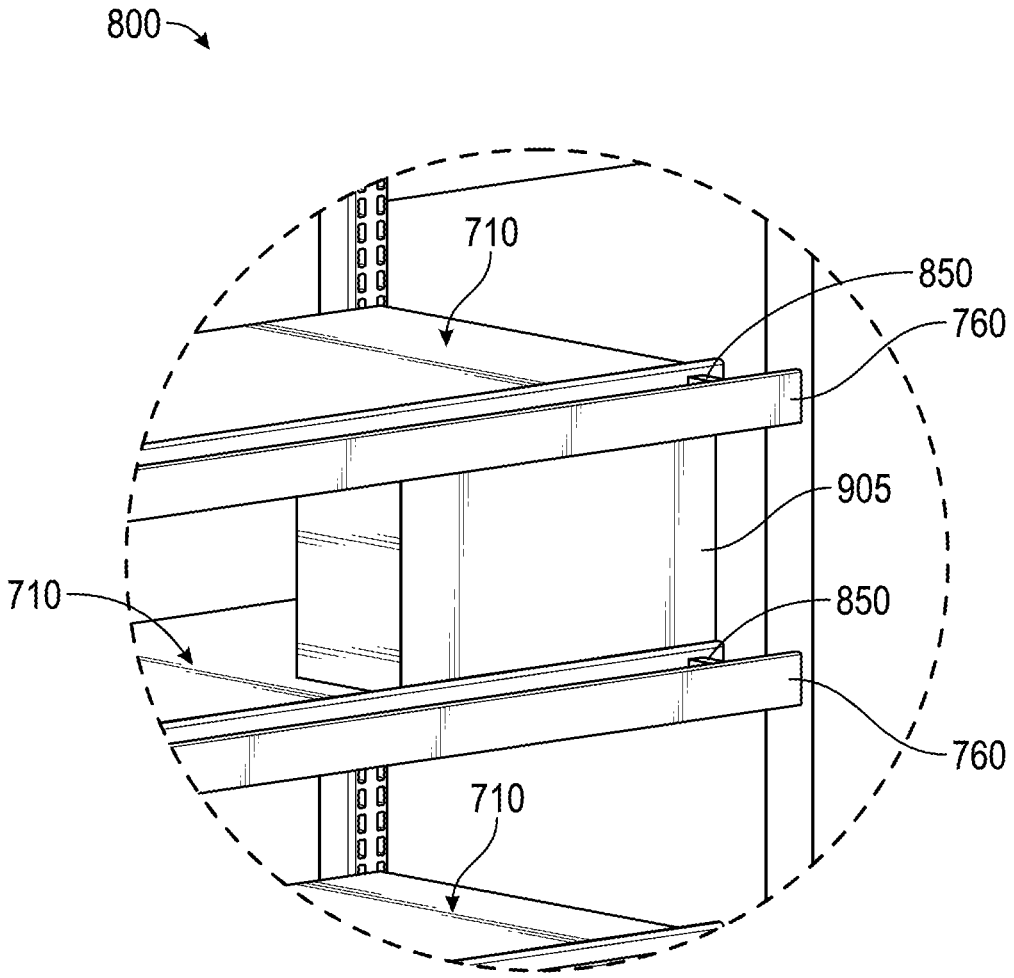
FIG. 9 is a detailed view of a product shown on a shelf of the temperature controlled case shown in FIG. 8.
Figure 10:
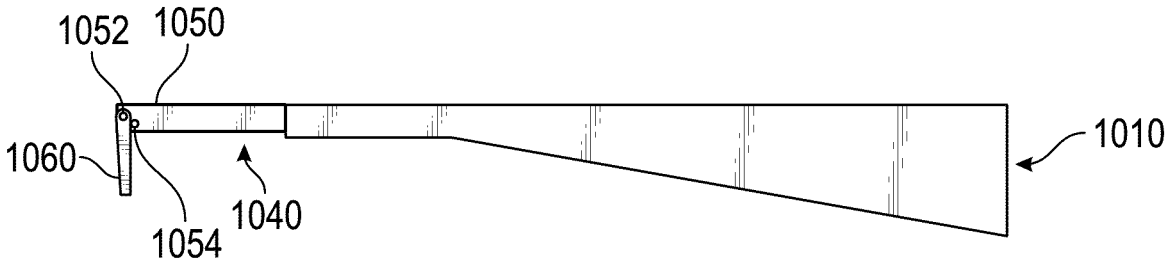
FIG. 10 is a side view of a shelf for a temperature controlled case in a first configuration, according to an exemplary embodiment of the present disclosure.
Figure 11:
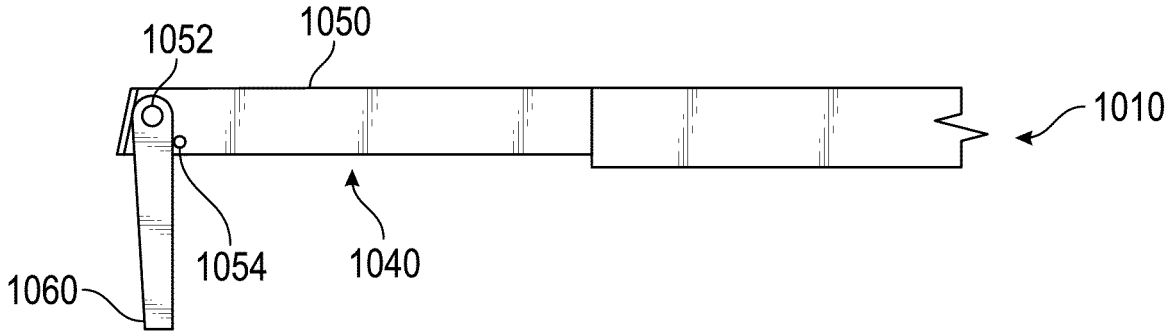
FIG. 11 is an enlarged view of a portion of the shelf shown in FIG. 10, according to an exemplary embodiment of the present disclosure.

FIGS. 8-9 illustrate a number of temperature controlled cases 700, shown as array of cases 800. As shown, temperature controlled case 700 may include a number of fourth beams, shown as support arms 850, and a first number of channels, shown as air channels 880. As shown in FIG. 8, shelves 710 may or may not include air channels 880. Air channels 880 may be configured to facilitate the passage of air-curtain 770 through shelves 710. Support arms 850 may be configured to support flow guides 760. Air channels 880 may be square shaped, rectangular shaped, circular shaped, triangular shaped, polygonal shaped, or any other shape or combination thereof such that temperature controlled case 700 is tailored for a target application. Through the cooperation of shelves 710 and air channels 880, control of air-curtain 770 is facilitated at various points such that air-curtain 770 may be tailored for a target application. For example, air-curtain 770 may be staggered, tapered, or narrowed, or any combination thereof, such that temperature controlled case 700 is tailored for a target application. As shown in FIG. 9, a product, shown as product 905, may be illuminated by luminaires incorporated into flow guides 760. Through the use of luminaires in flow guides 760, products 705 may be positioned along the front portion of shelves 710 while vital information about product 905 (e.g., product details, brand logo, etc.) is illuminated by the luminaires.

As shown in FIGS. 10-13, a fourth shelf, shown as shelf 1010, includes a fourth air straightener, shown as air straightener 1040. Air straightener 1040 may include a first mechanism, shown as gravity orientation mechanism 1042, a fifth beam, shown as support arm 1050, and a fifth flow guide, shown as flow guide 1060. Flow guide 1060 may contain a luminaire similar to luminaire 484. Gravity orientation mechanism 1042 may include a first pivot, shown as pivot 1052, and a first stop, shown as stop 1054. In various embodiments, shelf 1010 may be incorporated into any of temperature controlled case 100, temperature controlled case 200, temperature controlled case 600, temperature controlled case 700, and any other suitable temperature controlled case. The temperature controlled case may include any number of shelves 1010. For example, the temperature controlled case may include four shelves 1010. In many applications, it may be desirable to have the ability to reconfigure a temperature controlled case (e.g., temperature controlled case 100, temperature controlled case 200, temperature controlled case 600, temperature controlled case 700, etc.) at various points throughout the useful life of the temperature controlled case. For example, a user of the temperature controlled case may initially configure the temperature controlled case to display meat products; however, after observing lower demand for meat products, the user may wish to utilize the temperature controlled case to display fresh produce. According to various embodiments, shelf 1010 and air straightener 1040 are reconfigurable by the user such that the temperature controlled case may be tailored for various applications.

Figure 12:
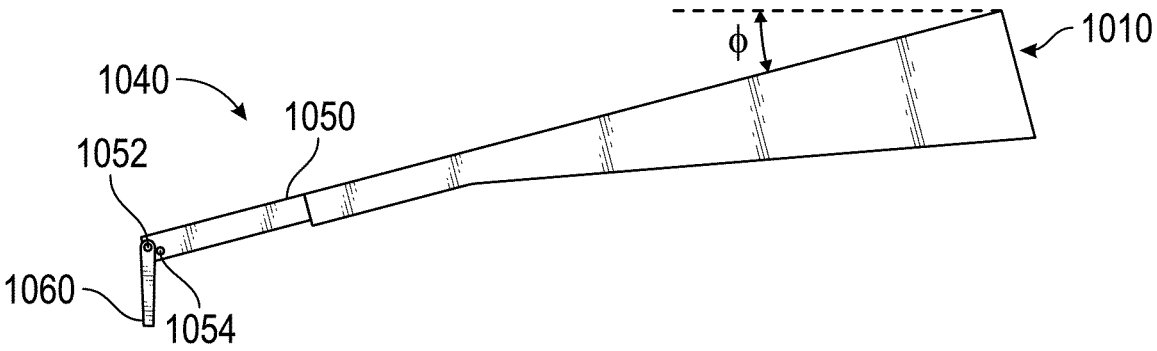
FIG. 12 is a side view of the shelf shown in FIG. 10 in a second configuration, according to an exemplary embodiment of the present disclosure.
Figure 13:
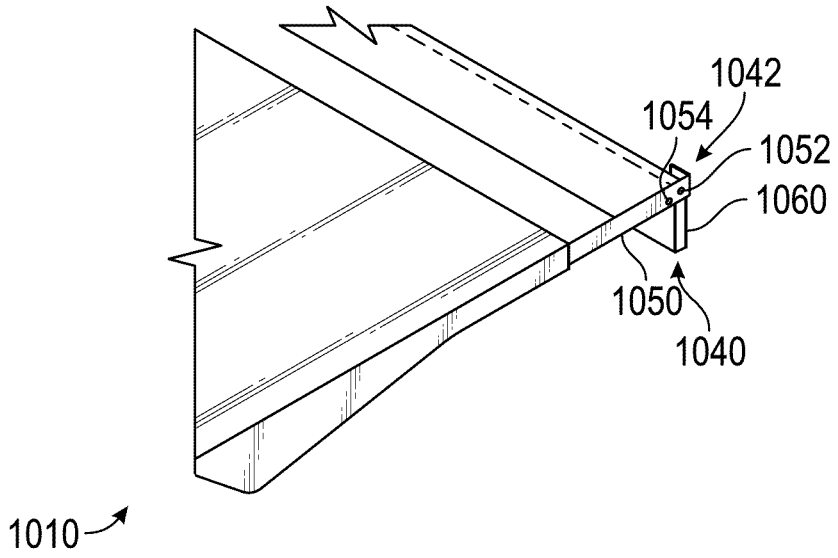
FIG. 13 is a top perspective view of a portion of the shelf shown in FIG. 10, according to an exemplary embodiment of the present disclosure.

In some applications, it may be desirable for shelf 1010 to be oriented at an angle. For example, shelf 1010 may be oriented at an angle such that display products may be arranged in a more aesthetically pleasuring or ergonomical manner. As shown in FIG. 12, shelf 1010 is oriented at an angle ϕ. When oriented at an angle (e.g., ϕ, etc.), gravity orientation mechanism 1042 may be configured to orient flow guide 1060 such that flow guide 1060 is perpendicular with a direction of gravity. Gravity orientation mechanism 1042 may thereby facilitate control of an air-curtain and illumination of products on shelves after a temperature controlled case has been reconfigured.

In some examples, a portion of flow guide 1060 may be constructed or weighted in order to orient flow guide 1060 in the direction of gravity. In various embodiments, flow guide 1060 is pivotable (e.g., rotatable, movable, etc.) about pivot 1052. Pivot 1052 may be a mechanism such as a pin, a bolt, a beam, a bar, a stud, a wire, or any other suitable mechanism such that shelf 1010 may be tailored for a target application. In some applications, it may be desirable to limit the rotation of flow guide 1060. In some embodiments, gravity orientation mechanism 1042 includes stop 1054 configured to limit the rotation of flow guide 1060. In various embodiments, stop 1054 is located on support arm 1050. Stop 1054 may be a mechanism such as a pin, a bolt, a beam, a bar, a stud, a wire, or any other suitable mechanism such that shelf 1010 may be tailored for a target application. Shelf 1010 may have two support arms 1050 each optionally including stop 1054. Stop 1054 may be configured to provide possible orientations for flow guide 1060. For example, a location of stop 1054 may correspond to a twenty degree orientation (e.g., ϕ is equal to twenty degrees) of shelf 1010. In some embodiments, the location of stop 1054 may correspond to a zero degree orientation (e.g., ϕ is equal to zero degrees) of shelf 1010. Air straightener 1040 may accommodate multiple positions of stop 1054 and/or pivot 1052. For example, support arm 1050 may include a number of holes configured to selectively receive pivot 1052 and/or stop 1054. According to this example, pivot 1052 and/or stop 1054 may be selectively repositionable within any of the holes. Pivot 1052 and/or stop 1054 may be retained within flow guide support arm 1050 through a structural mechanism (e.g., through a threaded interface, a snap fit, a friction fit, etc.), magnetic mechanism, adhesive mechanism, permanent mechanism (e.g., welded, riveted, etc.), or any other suitable mechanism such that shelf 1410 may be tailored for a target application. In some embodiments, shelf 1010 does not include stop 1054.

Figure 14:
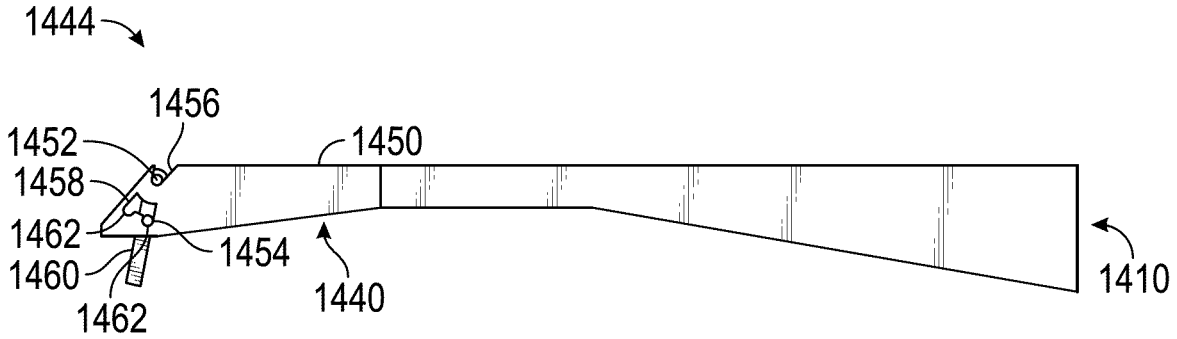
FIG. 14 is a side view of another shelf for a temperature controlled case in a first configuration, according to an exemplary embodiment of the present disclosure.
Figure 15:
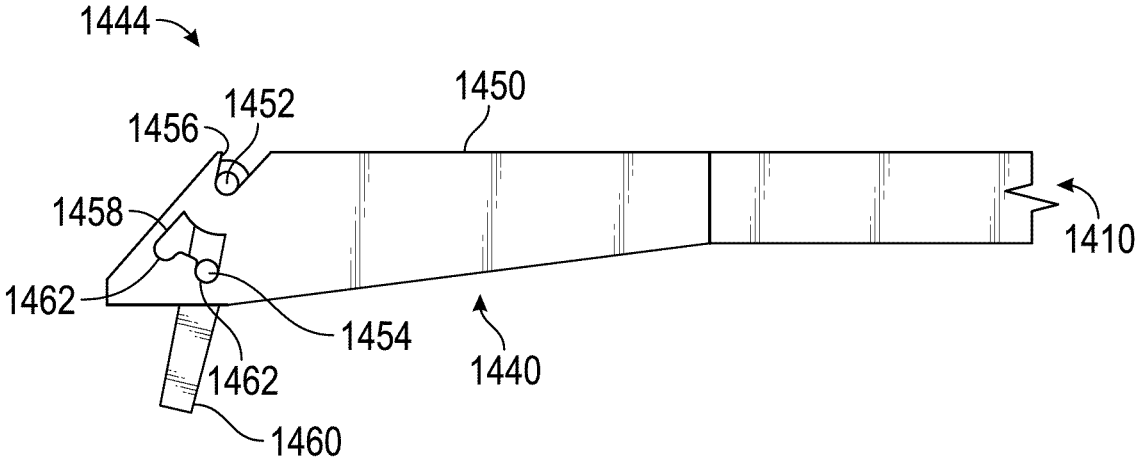
FIG. 15 is an enlarged view of a portion of the shelf shown in FIG. 14, according to an exemplary embodiment of the present disclosure.
Figure 16:
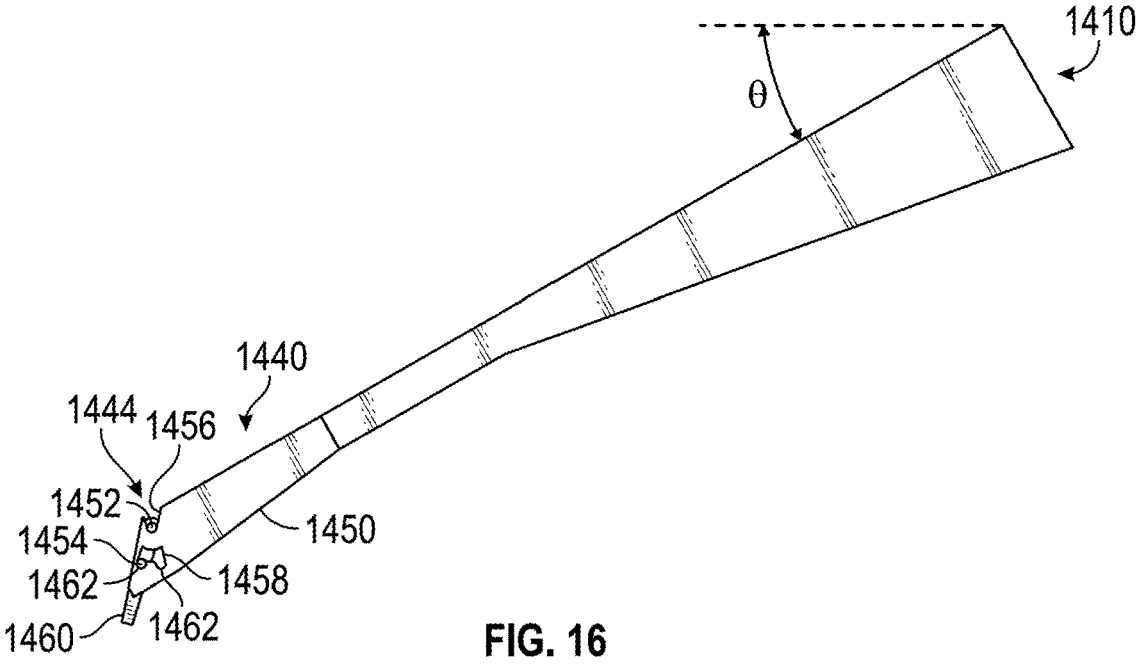
FIG. 16 is side view of the shelf shown in FIG. 14 in a second configuration, according to an exemplary embodiment of the present disclosure.

As shown in FIGS. 14-16, a fifth shelf, shown as shelf 1410, includes a fifth air straightener, shown as air straightener 1440, and a second mechanism, shown as cam-track mechanism 1444. Air straightener 1440 may include a sixth beam, shown as support arm 1450, and a sixth flow guide, shown as flow guide 1460. Flow guide 1460 may contain a luminaire similar to luminaire 484. Cam-track mechanism 1444 may include a second pivot, shown as pivot 1452, a second stop, shown as stop 1454, a first slot, shown as slot 1456, a second slot, shown as track 1458, and a number of third slots, shown as position slots 1462. In various embodiments, shelf 1410 may be incorporated into any of temperature controlled case 100, temperature controlled case 200, temperature controlled case 600, temperature controlled case 700, and any other suitable temperature controlled case. The temperature controlled case may include any number of shelves 1410. For example, the temperature controlled case may include four shelves 1410.

Similar to shelf 1010, shelf 1410 may be reconfigurable. Rather than using a gravity orientation mechanism, such as gravity orientation mechanism 1042, shelf 1410 may utilize cam-track mechanism 1444 to reposition flow guide 1460. Pivot 1452 may be a mechanism such as a pin, a bolt, a beam, a bar, a stud, a wire, or any other suitable mechanism such that shelf 1010 may be tailored for a target application. Stop 1454 may be a mechanism such as a pin, a bolt, a beam, a bar, a stud, a wire, or any other suitable mechanism such that shelf 1010 may be tailored for a target application. In various embodiments, pivot 1452 and/or stop 1454 are permanently attached to flow guide 1460. For example, pivot 1452 and stop 1454 may be welded, threaded, or structurally integrated into flow guide 1460. Flow guide 1460 may accommodate multiple positions of stop 1454 and/or pivot 1452. For example, flow guide 1460 may include a number of holes configured to selectively receive pivot 1452 and/or stop 1454. According to this example, pivot 1452 and/or stop 1454 may be selectively repositionable within any of the holes. Pivot 1452 and/or stop 1454 may be retained within flow guide 1460 through a structural mechanism (e.g., through a threaded interface, a snap fit, a friction fit, etc.), magnetic mechanism, adhesive mechanism, permanent mechanism (e.g., welded, riveted, etc.), or any other suitable mechanism such that shelf 1410 may be tailored for a target application.

When reconfiguring shelf 1410, a user may manipulate flow guide 1460 such that pivot 1452 moves within slot 1456 and such that stop 1454 moves within track 1458. To select an orientation of flow guide 1460, the user may locate stop 1454 within any one of position slots 1462 such that the desired orientation of flow guide 1460 is obtained. Cam-track mechanism 1444 may include any number of position slots 1462 in any suitable configuration. In some embodiments, shelf 1410 includes two position slots 1462. In other embodiments, shelf 1410 includes three position slots 1462. In various embodiments, the locations of position slots 1462 correspond to possible orientations of flow guide 1460. In some embodiments, the locations of position slots 1462 are configured to correspond to possible desired orientations of shelf 1410. It is understood that the shape and size of slot 1456 is configured to facilitate the repositioning of stop 1454 within track 1458 and that any suitable shape and/or size of slot 1456 may be utilized.

In some applications, it may be desirable for shelf 1410 to be oriented at an angle. For example, shelf 1410 may be oriented at an angle such that display products may be arranged in a more aesthetically pleasuring or ergonomical manner. As shown in FIG. 16, shelf 1410 is oriented at an angle θ. When oriented at an angle (e.g., θ, etc.), cam-track mechanism 1444 may enable a user to selectively reposition flow guide 1460 in one of position slots 1462. For example, one position slot 1462 may correspond to an angle of shelf 1410 of fifteen degrees (e.g., θ is fifteen degrees, etc.) while another position slot 1462 may correspond to an angle of shelf 1410 of zero degrees (e.g., θ is zero degrees, etc.). According to this example, shelf 1410 may be configured at fifteen degrees or zero degrees. In some embodiments, a first position slot 1462 may correspond to an angle of shelf 1410 of a first variable, x, (e.g., θ is equal to x, etc.), a second position slot 1462 may correspond to an angle of shelf 1410 of forty percent of the first variable, x, (e.g., θ is equal to forty percent of x, etc.), while a third position slot 1462 may correspond to an angle of shelf 1410 of zero degrees (e.g., θ is zero degrees, etc.). Cam-track mechanism 1444 may thereby facilitate control of an air-curtain and illumination of products on shelves after a temperature controlled case has been reconfigured.

Figure 17:
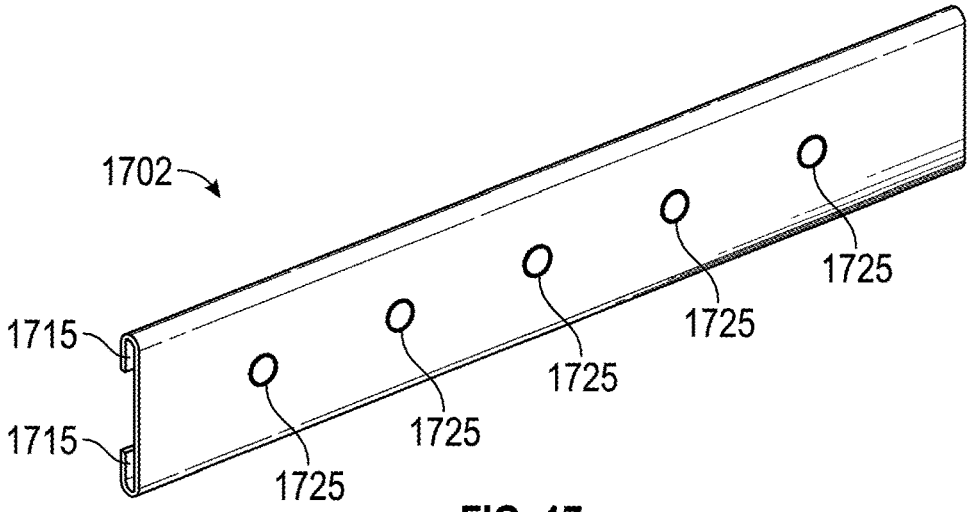
FIG. 17 is a top perspective view of a sliding track, according to an exemplary embodiment of the present disclosure.
Figure 18:
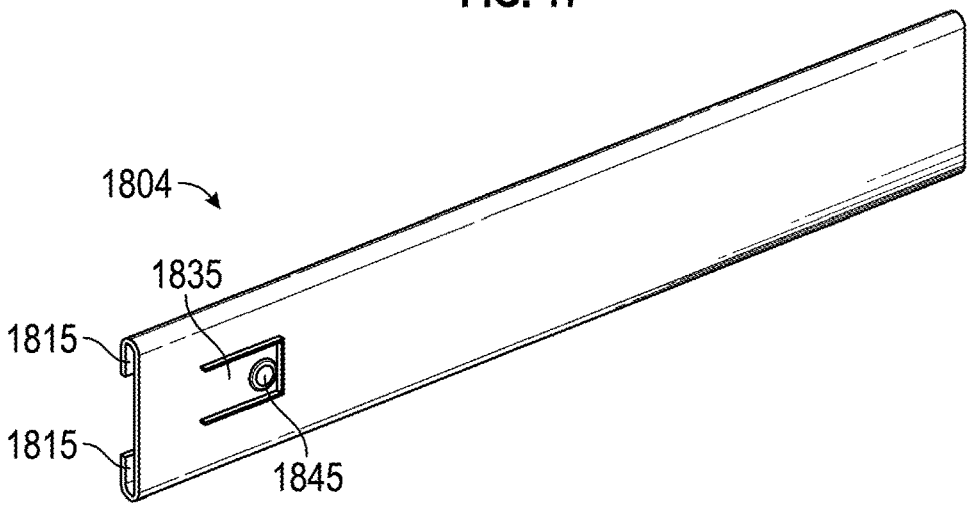
FIG. 18 is a top perspective view of a sliding insert, according to an exemplary embodiment of the present disclosure.

As shown in FIG. 17, a track, shown as sliding track 1702, includes a second number of channels, shown as channels 1715, and a number of holes, shown as positioning holes 1725. Sliding track 1702 may be configured to receive an insert within channels 1715. Referring to FIG. 18, an insert, shown as sliding insert 1804 includes a third number of channels, shown as channels 1815, a movable flap, shown as movable flap 1835, and a protrusion (e.g. protuberance, stud, etc.), shown as position lock 1845. In various embodiments, sliding track 1702 is configured to receive sliding insert 1804. In some embodiments, channels 1715 are configured to cooperate with channels 1815 to provide a sliding interface between sliding track 1702 and sliding insert 1804.

In various embodiments, sliding track 1702 and sliding insert 1804 cooperate to form a telescoping mechanism. The telescoping mechanism may be utilized to selectively reposition support arms (e.g., support arms 150, support arms 250, support arms 650, support arms 850, support arm 1050, support arm 1450, etc.) and/or shelves (e.g., shelves 110, shelves 210, shelves 710, shelf 1010, shelf 1410, etc.) such that flow guides (e.g., flow guides 160, flow guides 260, flow guide 460, flow guide 660, flow guides 760, flow guide 1060, flow guide 1460, etc.) may be positioned at a number of locations. For example, the shelves may be selectively repositioned such that the length of the shelves is within the inclusive range of 40.61 centimeters to 50.8 centimeters. In one embodiment with three shelves, the first shelf may be configured to have a length of 40.61 centimeters, the second shelf may be configured to have a length of 45.72 centimeters, and the third shelf may be configured to have a length of 50.8 centimeters. In various embodiments, positioning holes 1725 are configured to selectively receive position lock 1845. In some embodiments, positioning holes 1725 and position lock 1845 are both substantially circular. In other examples, positioning holes 1725 and position lock 1845 may be substantially square, substantially triangular, substantially polygonal, or any suitable combination thereof.

In one embodiment, sliding track 1702 includes five positioning holes 1725. In other examples, sliding track 1702 may include more or fewer positioning holes 1725. For example, sliding track 1702 may include one, two, three, four, six, seven, eight, or more positioning holes 1725. In various embodiments, positioning holes 1725 are spaced apart an equal distance from one another. In some embodiments, positioning holes 1725 are spaced 2.54 centimeters apart. In other embodiments, positioning holes 1725 are spaced 5.08 centimeters apart. In other examples, some positioning holes 1725 may not be spaced apart an equal distance from one another while other positioning holes 1725 are spaced apart an equal distance from one another. In various embodiments, the locations of positioning holes 1725 correspond to possible positions of the support arms (e.g., support arms 150, support arms 250, support arms 650, support arms 850, support arm 1050, support arm 1450, etc.) and/or the shelves (e.g., shelves 110, shelves 210, shelves 710, shelf 1010, shelf 1410, etc.).

Repositioning of the support arms and/or the shelves may allow a user to reposition the flow guides (e.g., flow guides 160, flow guides 260, flow guide 660, flow guides 760, flow guide 1060, flow guide 1460, etc.). In various embodiments, sliding track 1702 and sliding insert 1804 are operable between a locked position where position lock 1845 is retained (e.g., secured, engaged, located, maintained, etc.) within one of positioning holes 1725 and an unlocked (e.g., released, disengaged, etc.) position where position lock 1845 is not retained within one of positioning holes 1725. In some embodiments, movable flap 1835 is configured to bias position lock 1845 against sliding track 1702 such that position lock 1845 is retained within one of positioning holes 1725 when position lock 1845 is centered about one of positioning holes 1725. Movable flap 1835 may bias position lock 1845 through a structural resistance, spring force, or other suitable means.

In operation, a user may unlock (e.g., release, disengage, etc.) position lock 1845 from one of positioning holes 1725 by applying a force to position lock 1845 that is greater than the bias provided by movable flap 1835 while simultaneously translating (e.g., moving, etc.) one of the support arms and/or the shelves. In some embodiments sliding track 1702 is mounted to the shelves while sliding insert 1804 is mounted to a temperature controlled case (e.g., temperature controlled case 100, temperature controlled case 200, temperature controlled case 600, temperature controlled case 700, etc.). In other embodiments sliding track 1702 is mounted to the temperature controlled case while sliding insert 1804 is mounted to the shelves. In some embodiments sliding track 1702 is mounted to the shelves while sliding insert 1804 is mounted to the support arms. In other embodiments sliding track 1702 is mounted to the support arms while sliding insert 1804 is mounted to the shelves.

It is understood that while channels 1715 are shown and described to be configured to cooperate with channels 1815 to provide a sliding interface between sliding track 1702 and sliding insert 1804, that other suitable mechanisms and/or interfaces could be implemented between sliding track 1702 and sliding insert 1804. For example, sliding track 1702 and sliding insert 1804 may incorporate a roller-track mechanism (e.g., one of sliding track 1702 and sliding insert 1804 includes rollers or wheels), a rack and pinion mechanism, a ball-bearing track mechanism, or any other suitable mechanism. Additionally, sliding track 1702 and sliding insert 1804 may individually include bearings (e.g., ball bearings, etc.).

It is understood that the description of one of temperature controlled case 100, temperature controlled case 200, temperature controlled case 600, and temperature controlled case 700 similarly applies to the others of temperature controlled case 100, temperature controlled case 200, temperature controlled case 600, and temperature controlled case 700. It is further understood that the description of one of shelves 110, shelves 210, shelves 710, shelf 1010, and shelf 1410 similarly applies to the others of shelves 110, shelves 210, shelves 710, shelf 1010, and shelf 1410. It is further understood that the description of one of air-curtain discharge 120, air-curtain discharge 220, air-curtain discharge 620, and air-curtain discharge 720, similarly applies to the others of air-curtain discharge 120, air-curtain discharge 220, air-curtain discharge 620, and air-curtain discharge 720. It is further understood that the description of one of air-curtain return 130, air-curtain return 230, air-curtain return 630, and air-curtain return 730, similarly applies to the others of air-curtain return 130, air-curtain return 230, air-curtain return 630, and air-curtain return 730. It is further understood that the description of one of air straighteners 140, air straighteners 240, air straightener 640, air straightener 1040, and air straightener 1440 similarly applies to the others of air straighteners 140, air straighteners 240, air straightener 640, air straightener 1040, and air straightener 1440. It is further understood that the description of one of support arms 150, support arms 250, support arms 650, support arms 850, support arm 1050, and support arm 1450 similarly applies to the others of support arms 150, support arms 250, support arms 650, support arms 850, support arm 1050, and support arm 1450. It is further understood that the description of one of flow guides 160, flow guides 260, flow guide 460, flow guide 660, flow guides 760, flow guide 1060, and flow guide 1460 similarly applies to the others of flow guides 160, flow guides 260, flow guide 460, flow guide 660, flow guides 760, flow guide 1060, and flow guide 1460. It is further understood that the description of one of air-curtain 170, air-curtain 270, air-curtain 670, and air-curtain 770 similarly applies to the others of air-curtain 170, air-curtain 270, air-curtain 670, and air-curtain 770. It is further understood that the description of one of pivot 1052 and pivot 1452 similarly applies to the other of pivot 1052 and pivot 1452. It is further understood that the description of one of stop 1054 and stop 1454 similarly applies to the other of stop 1054 and stop 1454.

While only flow guides 460 have been shown to include luminaires 484, it is understood that any of flow guides 160, flow guides 260, flow guide 660, flow guides 760, flow guide 1060, and flow guide 1460 may similarly incorporate luminaires similar to luminaires 484. Accordingly, it is understood that the description of luminaire 484, LEDs 486, PCB 488, and all other components of flow guides 460 may similarly apply to similar components of flow guides 160, flow guides 260, flow guide 660, flow guides 760, flow guide 1060, and flow guide 1460.

It should be noted that references to "front," "rear," "upper," "top," "bottom," "base," and "lower" in this description are merely used to identify the various elements as they are oriented in the Figures. These terms are not meant to limit the element which they describe, as the various elements may be oriented differently in various temperature controlled cases.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the elements of temperature controlled case and the angled discharge diffuser provided herein are illustrative only. Although only a few exemplary embodiments of the present inventions have been described in detail in this disclosure, those skilled in the art who review this disclosure will readily appreciate that many modifications are possible in these embodiments (e.g., the structure of the diffuser, the discharge angle of the diffuser, the angle of the top and/or bottom portions of the duct that is adjacent to the diffuser, etc.) without materially departing from the novel teachings and advantages of the disclosure. Accordingly, all such modifications are intended to be within the scope of the disclosure.

What is claimed:

1. A temperature controlled case comprising:

a frame having a rear section, an upper section extending away from the rear section, and a lower section extending away from the rear section and spaced apart from the upper section to define a cavity therein, the cavity defining a product location configured to receive a product;

an air-curtain extending across the cavity, originating at an air-curtain discharge coupled to the upper section of the frame, and terminating at an air-curtain return coupled to the lower section of the frame;

a first shelf;

a second shelf located below the first shelf;

an air straightener coupled to and extending downwardly away from the first shelf, the air straightener comprising:

a flow guide comprising:

an upper channel;

a lower channel; and a stop;

a luminaire coupled to the lower channel, the luminaire comprising a LED and a PCB; and a support arm coupled to the upper channel and the first shelf; and a cam-track mechanism coupled to the support arm, the cam-track mechanism comprising a track with a first slot configured to receive the stop and a second slot contiguous with the first slot and configured to receive the stop;

wherein the flow guide is located at a location within the air-curtain;

wherein the flow guide is configured to control the air-curtain;

wherein the luminaire is configured to illuminate an illumination target; and wherein the stop and the track are configured to facilitate selective repositioning of the illumination target relative to the second shelf by adjusting an angular position of the flow guide relative to the first shelf.

2. The temperature controlled case of claim 1, wherein the flow guide is selectively repositionable between a number of angular positions including a position substantially parallel to a primary direction of the air-curtain.

3. The temperature controlled case of claim 1, further comprising:

a gravity orientation mechanism coupled to the air straightener;

wherein the gravity orientation mechanism is configured to facilitate a constant orientation of the flow guide within the air-curtain.

4. The temperature controlled case of claim 1, wherein the flow guide comprises a lens coupled to the lower channel;

wherein the lens includes a first leg configured to be received in the lower channel and a second leg configured to be received in the lower channel; and wherein the first leg and the second leg are configured to bias at least one of the LED or the PCB against the inner surface within the lower channel.

5. The temperature controlled case of claim 1, wherein:

the air straightener is coupled to the upper section of the frame using wires coupled to the upper section of the frame.

6. The temperature controlled case of claim 1, wherein:

the air straightener is selectively rotatable from a first position within the air-curtain to a second position outside the air-curtain.

7. A temperature controlled case comprising:

an air-curtain originating at an air-curtain discharge and terminating at an air-curtain return;

a first shelf defined by a first length and having a first flow guide coupled to a distal end of the first shelf, positioned proximate an inner wall of the air-curtain, and extending downwardly away from the first shelf, the first flow guide comprising a stop;

a second shelf below the first shelf defined by a second length that is different than the first length; and an air straightener formed integrally within the second shelf and comprising a second flow guide laterally offset from the first flow guide toward an outer wall of the air-curtain, the air straightener disposed within the air-curtain at a location between, and separate from, the air-curtain discharge and the air-curtain return;

a cam-track mechanism formed integrally within the distal end of the first shelf, the cam-track mechanism comprising a track with a first slot configured to receive the stop and a second slot contiguous with the first slot and configured to receive the stop;

wherein the first flow guide comprises a luminaire;

wherein the luminaire comprises a number of LEDs coupled to a number of PCBs;

wherein the luminaire has an illumination target where light produced by the number of LEDs is directed;

wherein the illumination target is located on the second shelf; and wherein the stop and the track are configured to facilitate selective repositioning of the illumination target along the second shelf by adjusting an angular position of the first flow guide relative to the first shelf.

8. The temperature controlled case of claim 7, wherein the second flow guide is selectively repositionable between a number of angular positions including a position substantially parallel to a primary direction of the air-curtain.

9. The temperature controlled case of claim 7, wherein the air straightener further includes:

at least one support arm formed integrally within the second shelf;

wherein the support arms, along with the second flow guide, define a number of air channels configured to facilitate passage of the air-curtain through the air straightener.

10. The temperature controlled case of claim 7, further comprising:

a gravity orientation mechanism coupled to the air straightener;

wherein the gravity orientation mechanism is configured to facilitate a constant orientation of the second flow guide within the air-curtain.

11. The temperature controlled case of claim 7, wherein the first flow guide further comprises a lens;

wherein the lens includes a first leg and a second leg; and wherein the first leg and the second leg are configured to bias the number of PCBs against the flow guide.

12. An air straightener for a temperature controlled case, the air straightener comprising:

a flow guide disposed within an air-curtain and comprising a stop;

a cam-track mechanism comprising a track having a first slot and a second slot; and a number of support arms each individually comprising a telescoping mechanism having a sliding track and a sliding insert movable relative to one another to adjust a length of each support arm;

wherein the flow guide comprises:

a lower channel;

an upper channel separate from the lower channel;

a bottom retaining edge;

a top retaining edge;

a luminaire having a number of LEDs coupled to a number of PCBs; and a lens comprising a lower leg, an upper leg, a lower edge, and an upper edge; and wherein the cam-track mechanism is configured to facilitate selective angular repositioning of the illumination target of the luminaire via movement of the stop within at least one of the first slot or the second slot.

13. The air straightener of claim 12, further comprising the temperature controlled case;

wherein the support arms are coupled to the temperature controlled case;

wherein the luminaire is configured to have an illumination target;

wherein the illumination target is a concentration of light emitted from the number of LEDs; and wherein the illumination target is configured to be located on at least one displayed product of the temperature controlled case.

14. The air straightener of claim 12, further comprising the temperature controlled case;

wherein support arms are coupled to a first shelf of the temperature controlled case;

wherein the luminaire is configured to have an illumination target;

wherein the illumination target is a concentration of light emitted from the number of LEDs; and wherein the illumination target is configured to be located on a second shelf of the temperature controlled case directly below the first shelf.

15. The air straightener of claim 12, further comprising the temperature controlled case;

wherein the luminaire is configured to have an illumination target;

wherein the illumination target is a concentration of light dispersed from the number of LEDs; and wherein the illumination target is configured to be located on a shelf of the temperature controlled case below the air straightener.

16. The air straightener of claim 12, further comprising a gravity orientation mechanism and the temperature controlled case;

wherein the luminaire is configured to have an illumination target;

wherein the illumination target is a concentration of light produced from the number of LEDs;

wherein the illumination target is configured to be located on a shelf of the temperature controlled case below the air straightener; and wherein the gravity orientation mechanism is configured to facilitate a constant orientation of the flow guide within the air-curtain.

17. The air straightener of claim 12, further comprising the temperature controlled case;

wherein the sliding inserts individually comprise a movable flap having a position lock;

wherein the sliding tracks individually comprise a number of positioning holes configured to selectively receive the position lock and corresponding to a number of positions of the flow guide;

wherein the luminaire is configured to have an illumination target;

wherein the illumination target is a concentration of light emitted from the number of LEDs;

wherein the illumination target is configured to be located on a shelf of the temperature controlled case below the air straightener;

wherein the telescoping mechanisms cooperate to facilitate selective repositioning of the illumination target along the shelf of the temperature controlled case below the air straightener; and wherein the sliding tracks are coupled to a shelf in the temperature controlled case and the sliding inserts slide relative to the sliding tracks to adjust a distance between the flow guide and the shelf.

18. The air straightener of claim 12, wherein the number of PCBs are biased against the lower channel by the lower leg and the upper leg; and wherein the lens is retained in the flow guide by an interaction between the bottom retaining edge and the lower edge of the lens and an interaction between the top retaining edge and the upper edge of the lens.

* * * * *